US012534318B2

(12) United States Patent
Morisawa et al.

(10) Patent No.: US 12,534,318 B2
(45) Date of Patent: Jan. 27, 2026

(54) MEDIUM TRANSPORT DEVICE AND MEDIUM TRANSPORT METHOD

(71) Applicant: SEIKO EPSON CORPORATION, Tokyo (JP)

(72) Inventors: Ryoichi Morisawa, Shiojiri (JP); Masashi Ogawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 18/366,928

(22) Filed: Aug. 8, 2023

(65) Prior Publication Data

US 2024/0051772 A1 Feb. 15, 2024

(30) Foreign Application Priority Data

Aug. 9, 2022 (JP) ..... 2022-126848

(51) Int. Cl.
*B65H 5/06* (2006.01)
*B65H 3/06* (2006.01)
*B65H 9/16* (2006.01)

(52) U.S. Cl.
CPC ..... *B65H 3/0669* (2013.01); *B65H 5/06* (2013.01); *B65H 9/166* (2013.01); *B65H 2404/152* (2013.01); *B65H 2801/06* (2013.01)

(58) Field of Classification Search
CPC .... B65H 3/0669; B65H 2403/72; B65H 5/06; B65H 9/166; B65H 2513/41
See application file for complete search history.

(56) References Cited

U.S. PATENT DOCUMENTS 10,144,600 B2 * 12/2018 Hanamoto ..... H04N 1/00602
10,341,516 B2 * 7/2019 Imaki ..... B65H 5/06
2020/0207562 A1 * 7/2020 Chiba ..... B65H 3/0684

FOREIGN PATENT DOCUMENTS

JP 4117841 B2 * 7/2008 ..... B65H 3/0615
JP 2014-162570 A 9/2014
JP 2018039582 A * 3/2018

OTHER PUBLICATIONS

Translation of JP-2018039582-A (Year: 2025).*
Translation of JP-4117841-B2 (Year: 2025).*

* cited by examiner

*Primary Examiner* — Howard J Sanders
(74) *Attorney, Agent, or Firm* — WORKMAN NYDEGGER

(57) ABSTRACT

A medium transport device includes a feed roller, a separation roller that nips the medium P together with the feed roller and separates a plurality of stacked medium, a drive section that generates a driving force, a one way clutch section provided in a transmission path for transmitting the driving force to the feed roller, wherein the one way clutch section is configured to switch between an allowed state in which the feed roller allowed to rotate in a rotation direction in which the medium are moved in a reverse feed direction and a restricted state in which this is not allowed and it is causes the one way clutch section to the allowed state, and that is configured to rotate the separation roller in the rotation direction in which the medium moves in the reverse feed direction.

8 Claims, 14 Drawing Sheets

MEDIUM TRANSPORT DEVICE AND MEDIUM TRANSPORT METHOD

The present application is based on, and claims priority from JP Application Serial Number 2022-126848, filed Aug. 9, 2022, the disclosure of which is hereby incorporated by reference herein in its entirety.

BACKGROUND

1. Technical Field

The present disclosure relates to a medium transport device and a medium transport method.

2. Related Art

In the related art, a medium transport device is used in which a plurality of medium can be stacked and placed on a placement section and the plurality of stacked medium can be fed one sheet at a time. Among such medium transport devices, there is a configuration in which a medium multi-feed suppressing operation is performed to return a subsequent medium subsequent to a preceding medium to the placement section side. For example, an image forming device is disclosed in which a JP-A-2014-162570 is provided with a feed roller that feeds medium, a motor, an electromagnetic clutch that turns on and off the transmission of driving force from the motor to the feed roller, and a retard roller that is provided at a position facing the feed roller and returns the subsequent medium that follow the preceding medium to the placement section side.

The image forming device of JP-A-2014-162570 has a configuration in which the electromagnetic clutch is turned off to set the feed roller in a freely rotatable state, is configured to be return the subsequent medium to the placement section side by rotating the retard roller. On the other hand, in the image forming device of JP-A-2014-162570, it is conceivable that a rotational force acts on the retard roller in a direction in which the medium is returned to the placement section side after the preceding medium passes through a nip position between the feed roller and the retard roller. This is because the retard roller is often provided with a torque limiter having a spring, and spring back occurs as the preceding medium is released from the nip position. Since the feed roller is in a freely rotatable state, in accordance with the rotational force of the retard roller, a rotational force which acts in a direction in which the medium is returned to the placement section side also acts on the feed roller which faces the retard roller, and the subsequent medium may be blown off to the placement section side with great force. It is conceivable to provide the feed roller with a one way clutch that allows the feed roller to rotate only in one direction, only from the viewpoint of suppressing the subsequent medium from being blown off to the placement section side with great force. However, in the conventional medium transport device such as an image forming device of JP-A-2014-162570, it is difficult to appropriately return the subsequent medium to the placement section side by the retard roller simply by providing the one way clutch.

SUMMARY

A medium transport device of the present disclosure for solving the above described problem includes a placement section on which a medium is placed; a feed roller configured to feed the medium from the placement section in a feed direction; a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium; a drive mechanism section configured to drive the feed roller and the separation roller, wherein the drive mechanism section includes a drive section that generates a driving force and a one way clutch section that is provided in a transmission path, which transmits the driving force to the feed roller, the one way clutch section is configured to switch between an allowed state in which the one way clutch section allows the feed roller to rotate in a rotation direction in which the feed roller moves the medium in the reverse feed direction and a restricted state in which the one way clutch section allows the feed roller to rotate only in a rotation direction in which the feed roller moves the medium in the feed direction, and the drive mechanism section that causes the one way clutch section to enter the allowed state and that causes the separation roller to rotate in the rotation direction in which the medium moves in the reverse feed direction.

In addition, in a medium transport method of the present disclosure for solving the above described problem, a medium transport device including: a placement section on which a medium is placed; a feed roller configured to feed the medium from the placement section in a feed direction; a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium; a drive mechanism section for driving the feed roller and the separation roller; a drive section that generates a driving force; and a one way clutch section that is provided in a transmission path, that transmits the driving force to the feed roller, and that configured to switch between an allowed state in which the one way clutch section allows the feed roller to rotate in a rotation direction in which the feed roller moves the medium in the reverse feed direction and a restricted state in which the one way clutch section allows the feed roller to rotate only in a rotation direction in which the feed roller moves the medium in the feed direction, the medium transport method includes a feeding step of feeding the medium in the feed direction by nipping the medium between the feed roller and the separation roller and a subsequent medium returning step of causing the one way clutch section to enter the allowed state and of rotating the separation roller in the rotation direction in which the medium moves in the reverse feed direction to return, in the reverse feeding direction, a subsequent medium, which is a medium subsequent to a preceding medium transported in the feeding step.

DESCRIPTION OF EMBODIMENTS

Figure 1:
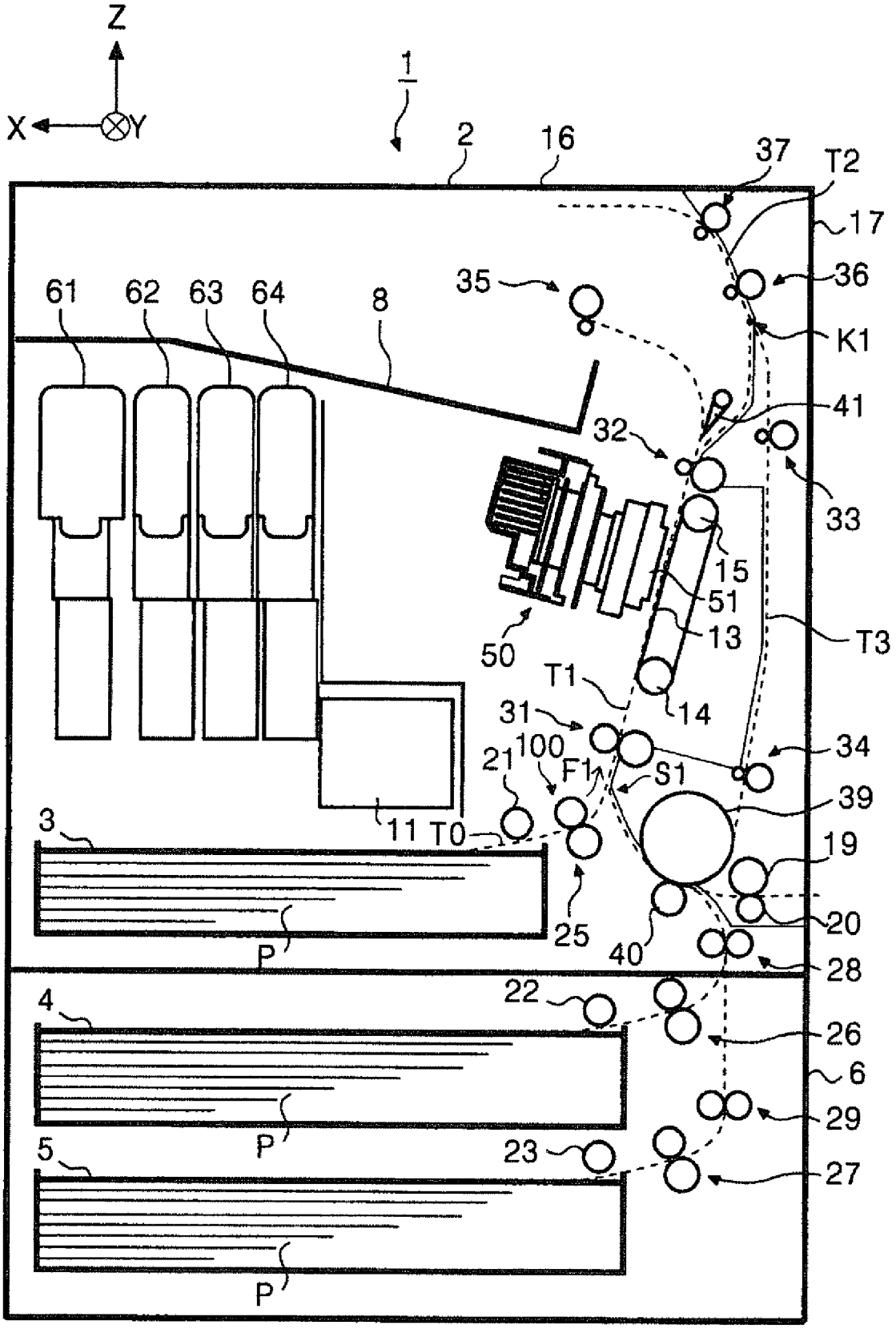
FIG. 1 is a front view showing an internal configuration of a printer according to a first embodiment of the present disclosure.

The disclosure will be described in general terms.

A medium transport device according to a first aspect of the present disclosure includes a placement section on which a medium is placed; a feed roller configured to feed the medium from the placement section in a feed direction; a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium; a drive mechanism section configured to drive the feed roller and the separation roller, wherein the drive mechanism section includes a drive section that generates a driving force and a one way clutch section that is provided in a transmission path, which transmits the driving force to the feed roller, the one way clutch section is configured to switch between an allowed state in which the one way clutch section allows the feed roller to rotate in a rotation direction in which the feed roller moves the medium in the reverse feed direction and a restricted state in which the one way clutch section allows the feed roller to rotate only in a rotation direction in which the feed roller moves the medium in the feed direction, and the drive mechanism section that causes the one way clutch section to enter the allowed state and that causes the separation roller to rotate in the rotation direction in which the medium moves in the reverse feed direction.

According to the present aspect, the one way clutch section which can be switched between the allowed state in which the feed roller is allowed to rotate in the rotation direction in which the medium is moved in the reverse feed direction and the restricted state in which the feed roller is allowed to rotate only in the rotation direction in which the medium is moved in the feed direction is provided. For this reason, it is possible to appropriately return the subsequent medium subsequent to the preceding medium to the placement section side while suppressing the subsequent medium from being blown off with great force to the placement section side after the preceding medium passes through the nip position between the feed roller and the separation roller.

According to a second aspect of the present disclosure, the medium transport device according to the first aspect, further includes a transport roller that is provided upstream of the feed roller in the feed direction and that is configured to transport the medium from the placement section toward the feed roller, wherein the drive mechanism section includes a switching section that switches the transport roller between a contacted state in which the transport roller is in contact with the medium and a separated state in which the transport roller is separated from the medium, the drive mechanism section is configured to transmit the driving force to the transport roller, and the drive mechanism section switches the one way clutch section between the restricted state and the allowed state by a switching operation of the switching section between the contacted state and the separated state.

According to the present aspect, the drive mechanism section includes the switching section that switches the transport roller between the contacted state in which the transport roller is in contact with the medium and the separated state in which the transport roller is separated from the medium, the drive mechanism section is configured to transmit the driving force to the transport roller, and the drive mechanism section switches the one way clutch section between the restricted state and the allowed state by the switching operation of the switching section between the contacted state and the separated state. That is, the state of the one way clutch section can be switched by using the force for switching the state of the transport roller. Therefore, the configuration of the device can be simplified.

According to a third aspect of the present disclosure, the medium transport device according to the second aspect, wherein the drive mechanism section brings the one way clutch section into the restricted state when the switching section brings the transport roller into the contacted state, and brings the one way clutch section into the allowed state when the switching section brings the transport roller into the separated state.

According to the present aspect, the drive mechanism section brings the one way clutch section into the restricted state when the switching section brings the transport roller into the contacted state, and brings the one way clutch section into the allowed state when the switching section brings the transport roller into the separated state. For this reason, by setting the transport roller to the separated state when returning the subsequent medium subsequent to the preceding medium to the placement section side, it is possible to suppress the occurrence of jam or skew due to the leading edge of the subsequent medium in the reverse feed direction being caught by the transport roller.

According to a fourth aspect of the present disclosure, the medium transport device according to any one of the first to third aspects, wherein the one way clutch section has a star ratchet.

According to the present aspect, the one way clutch section has the star ratchet. With such a configuration, it is possible to reduce the size of the drive mechanism section, which in turn can reduce the size of the device.

According to a fifth aspect of the present disclosure, the medium transport device according to any one of the first to third aspects, further includes a skew correction section that is provided downstream of the feeding roller in the feed direction and that is configured to contact the medium and to correct skew of the medium, wherein when the medium fed by the feed roller comes into contact with the skew correction section, the drive mechanism section brings the one way clutch section into the restricted state and interrupts transmission of the driving force to the feed roller.

According to the present aspect, when the medium fed by the feed roller comes into contact with the skew correction section, the drive mechanism section brings the one way clutch section into the restricted state and interrupts transmission of the driving force to the feed roller. With such a configuration, it is possible to prevent the preceding medium from being damaged or jammed due to continuous application of a force for feeding the preceding medium in the feed direction after the preceding medium contacts with the skew correction section.

According to a sixth aspect of the present disclosure, the medium transport device according to the fifth aspect, further includes a transport roller that is provided upstream of the feed roller in the feed direction and that is configured to transport the medium from the placement section toward the feed roller, wherein the drive mechanism section includes a switching section that switches the transport roller between a contacted state in which the transport roller is in contact with the medium and a separated state in which the transport roller is separated from the medium, the drive mechanism section is configured to transmit the driving force to the transport roller, the skew correction section includes a transport roller pair that transports the medium, and when the medium whose skew was corrected by the skew correction section is transported by the transport roller pair, the switching section switches the transport roller from the contacted state to the separated state.

According to the present aspect, when the medium whose skew was corrected by the skew correction section is transported by the transport roller pair, the switching section switches the transport roller from the contacted state to the separated state. That is, when the medium that skew has been corrected is transported by the transport roller pair, the medium is not transported by the transport roller. Thus, by reducing the number of transport sections that are concerned with transport of the medium, the transport load can be reduced.

According to a seventh aspect of the present disclosure, the medium transport device according to the fifth or sixth aspect, further includes a recording section that is provided downstream of the skew correction section in the feed direction and that is configured to perform recording on the medium, wherein the drive mechanism section continues to transmit the driving force to the feed roller until a trailing edge in the feed direction of the medium on which recording is being performed by the recording section passes through a nip position between the feed roller and the separation roller.

When the driving force is no longer transmitted to the feed roller before the medium passes through the nip position between the feed roller and the separation roller in a state in which recording is being performed by the recording section, the transport distance per unit time may suddenly change, and the recording quality may deteriorate. However, according to the present aspect, the drive mechanism section continues to transmit the driving force to the feed roller until the trailing edge in the feed direction of the medium on which recording is being performed by the recording section passes through the nip position between the feed roller and the separation roller. For this reason, it is possible to suppress a sudden change in the transport distance per unit time in a state in which recording is being performed by the recording section, and it is possible to suppress a decrease in recording quality.

A medium transport method according to an eighth aspect of the present disclosure, the medium transport device including: a placement section on which a medium is placed; a feed roller configured to feed the medium from the placement section in a feed direction; a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium; a drive mechanism section for driving the feed roller and the separation roller; a drive section that generates a driving force; and a one way clutch section that is provided in a transmission path, that transmits the driving force to the feed roller, and that configured to switch between an allowed state in which the one way clutch section allows the feed roller to rotate in a rotation direction in which the feed roller moves the medium in the reverse feed direction and a restricted state in which the one way clutch section allows the feed roller to rotate only in a rotation direction in which the feed roller moves the medium in the feed direction, the medium transport method includes a feeding step of feeding the medium in the feed direction by nipping the medium between the feed roller and the separation roller and a subsequent medium returning step of causing the one way clutch section to enter the allowed state and of rotating the separation roller in the rotation direction in which the medium moves in the reverse feed direction to return, in the reverse feeding direction, a subsequent medium, which is a medium subsequent to a preceding medium transported in the feeding step.

According to the present aspect, the one way clutch section which can be switched between the allowed state in which the feed roller is allowed to rotate in the rotation direction in which the medium is moved in the reverse feed direction and the restricted state in which the feed roller is allowed to rotate only in the rotation direction in which the medium is moved in the feed direction is provided, and the subsequent medium returning step of returning the subsequent medium in the reverse feed direction by setting the one way clutch section to the allowed state and rotating the separation roller in the rotation direction for moving the medium in the reverse feed direction is executed as the medium multi-feed suppressing operation. For this reason, it is possible to appropriately return the subsequent medium subsequent to the preceding medium to the placement section side while suppressing the subsequent medium from being blown off with great force to the placement section side after the preceding medium passes through the nip position between the feed roller and the separation roller.

First Embodiment

Hereinafter, the present disclosure will be specifically described. First, an inkjet printer 1 of a first embodiment, which is a medium transport device of the present disclosure and is also a recording device, will be described. Hereinafter, the inkjet printer 1 will be referred to simply as a printer 1. An X-Y-Z coordinate system shown in each drawing is an orthogonal coordinate system, and a Y-axis direction is a direction intersecting with a transport direction of a medium P, that is, a medium width direction, and is also the device depth direction. In the Y-axis direction, a +Y direction is a direction from a device front surface toward a device rear surface, and a −Y direction is a direction from the device rear surface toward the device front surface.

An X-axis direction is a device width direction and, as viewed from an operator of the printer 1, a +X direction is to the left side and a −X direction is to the right side. A Z-axis direction is a vertical direction, that is, a device height direction, and a +Z direction is an upward direction and a −Z direction is a downward direction. Hereinafter, a direction in which the medium P is fed may be referred to as "downstream", and a direction opposite thereto may be referred to as "upstream". In the figures, a medium transport path is indicated by dashed line. In the printer 1, the medium P is transported through the medium transport path indicated by a dashed line.

As shown in FIG. 1, the printer 1 includes a housing section 16 of a device main body 2, and a door section 17 which is pivotable with respect to the housing section 16 by using a shaft (not shown) extending in the Z-axis direction as a pivot axis. In addition, the printer 1 includes a first medium cassette 3 which accommodates the medium P such as printing paper in a lower portion of the device main body 2, and further is configured such that an additional unit 6 can be coupled to a lower side of the device main body 2. When the additional unit 6 is connected, a second medium cassette 4 and a third medium cassette 5 are positioned below the first medium cassette 3. The medium P fed out from the medium cassettes is transported inside the printer 1 in the medium transport path indicated by a dashed line.

Each of the medium cassettes are provided with a pickup roller that sends out the accommodated medium P in the −X direction. The pickup rollers 21, 22, and 23 are pickup rollers provided for the first medium cassette 3, the second medium cassette 4, and the third medium cassette 5, respectively. The medium cassettes are provided with a feed roller pair that feeds the medium P fed out in the −X direction obliquely upward. Feed roller pairs 25, 26, and 27 are feed rollers provided for the first medium cassette 3, the second medium cassette 4, and the third medium cassette 5, respectively. In the following description, unless otherwise specified, a "roller pair" includes a drive roller that is driven by a motor 210 (to be described later) and a driven roller that is driven to rotate by contact with the drive roller.

A medium P fed out from the third medium cassette 5 is sent to an inversion roller 39 by transport roller pairs 29 and 28. A medium P fed out from the second medium cassette 4 is sent to the inversion roller 39 by the transport roller pair 28. The medium P is nipped between the inversion roller 39 and the driven roller 40 and is sent to a transport roller pair 31. A medium P fed out from the first medium cassette 3 is sent to the transport roller pair 31 without passing by the inversion roller 39. Here, the transport roller pair 31 serves as a skew correction section. A feed roller 19 and a separation roller 20 provided near the inversion roller 39 are a roller pair that feeds the medium P from a feed tray (not shown).

The medium P that receives a feeding force from the transport roller pair 31 is fed to a position between a transport belt 13 and the line head 51, which is an example of a recording section, that is, to a recording position facing the line head 51. Hereinafter, the medium transport path from the transport roller pair 31 to a transport roller pair 32 will be referred to as a recording transport path T1.

The line head 51 constitutes the head unit 50. The line head 51 executes recording by ejecting ink, which is an example of liquid, onto the surface of the medium P. The line head 51 is an ink ejecting head configured such that nozzles that eject ink cover the entire area in the medium width direction, and is configured as the ink ejecting head capable of recording on the entire area in the medium width direction without moving in the medium width direction. However, the ink ejection head is not limited thereto, and may be a type that is mounted on a carriage and that ejects ink while moving in the medium width direction. Further, as the recording section, it is also possible to use a recording section having a configuration other than an ink ejection head, such as a thermal transfer type recording section.

The printer 1 includes ink containers 61, 62, 63, and 64 as a liquid container. Ink ejected from the line head 51 is supplied from the ink containers to the line head 51 via tubes (not shown). The ink containers are detachably provided. The printer 1 also includes a waste liquid container 11 that stores, as waste liquid, ink discharged for maintenance from the line head 51 toward a flushing cap (not shown).

The transport belt 13 is an endless belt which is wound around a pulley 14 and a pulley 15, and rotates when at least one of the pulley 14 and the pulley 15 is driven by a motor (not shown). The medium P is transported to a position facing the line head 51 while being attracted to the belt surface of the transport belt 13. The attraction of the medium P to the transport belt 13 may employ a known attraction method such as an air suction method or an electrostatic attraction method.

The recording transport path T1 that passes through the position facing the line head 51 forms an angle with respect to the horizontal direction and the vertical direction, and transports the medium P upward. This upward transport direction is a direction including a −X direction component and a +Z direction component in FIG. 1, and with such a configuration, it is possible to suppress the horizontal direction dimension of the printer 1.

The medium P on which recording has been performed on the first surface by the line head 51 is further transported upward by the transport roller pair 32, which is positioned downstream from the transport belt 13. A flap 41 is provided downstream of the transport roller pair 32, and the transport direction of the medium P is switched by the flap 41. When the medium P is to be discharged as is, the transport path of the medium P is switched upward by the flap 41 toward a transport roller pair 35, and the medium P is discharged toward a discharge tray 8 by the transport roller pair 35.

When, in addition to the first surface of the medium P, recording is to be performed on a second surface, which is opposite to the first surface, the transport direction of the medium P is directed by the flap 41 toward a branch position K1. Then, the medium P passes through the branch position K1 and enters a switchback path T2. In the present embodiment, the switchback path T2 is the medium transport path above the branch position K1. Transport roller pairs 36 and 37 are provided in the switchback path T2. The medium P entering the switchback path T2 is transported upward by the transport roller pairs 36 and 37, and when the trailing edge of the medium P has passed through the branch position K1, the rotation direction of the transport roller pairs 36 and 37 is switched, and the medium P is thereby transported downward. Note that the "upward direction" does not mean only the vertically upward direction, but means that at least a vector component in the vertically upward direction is included, and the "downward direction" does not mean only the vertically downward direction, but means that at least a vector component in the vertically downward direction is included.

An inversion path T3 is connected to the switchback path T2. In the present embodiment, the inversion path T3 is a medium transport path from the branch position K1, past transport roller pairs 33 and 34 and the inversion roller 39, to the merging point S1. The medium P transported downward from the branch position K1 receives feeding force from the transport roller pairs 33 and 34, reaches the inversion roller 39, is inverted by curling around the inversion roller 39, and is transported toward the transport roller pair 31.

The medium P transported by the transport roller pair 31 and the like and again sent to the position facing the line head 51 has the second surface, which is the opposite side than the first surface on which recording has already been performed, facing the line head 51. This enables recording by the line head 51 on the second surface of the medium P. Here, the medium transport path from the first medium cassette 3 to the transport roller pair 31 is referred to as a feed path TO.

Next, with reference to FIGS. 2 to 12 in addition to FIG. 1, a drive mechanism section 100 which is a main portion of the printer 1 of the present embodiment will be described. A drive mechanism section 100A of the embodiment as the drive mechanism section 100 is a mechanism that drives the rollers and that changes the position of the rollers, in a region in which the medium P placed on the first medium cassette 3 as a placement section on which the medium P is placed is transports to the recording position by the line head 51. As shown in FIG. 1, in the printer 1 of the present embodiment, a distance from the first medium cassette 3 to the position facing the line head 51 which is the recording position is short. For this reason, when the medium P is transported from the first medium cassette 3 to the recording position, the medium P is simultaneously transported by a plurality of transport sections among the pickup roller 21, the feed roller pair 25, the transport roller pair 31, and the transport belt 13. In the present disclosure, it is possible to solve a detrimental caused by the medium P being simultaneously transported by a plurality of transport sections in, for example, a small medium transport device in which the medium P is simultaneously transported by the plurality of transport sections as described above.

Figure 6:
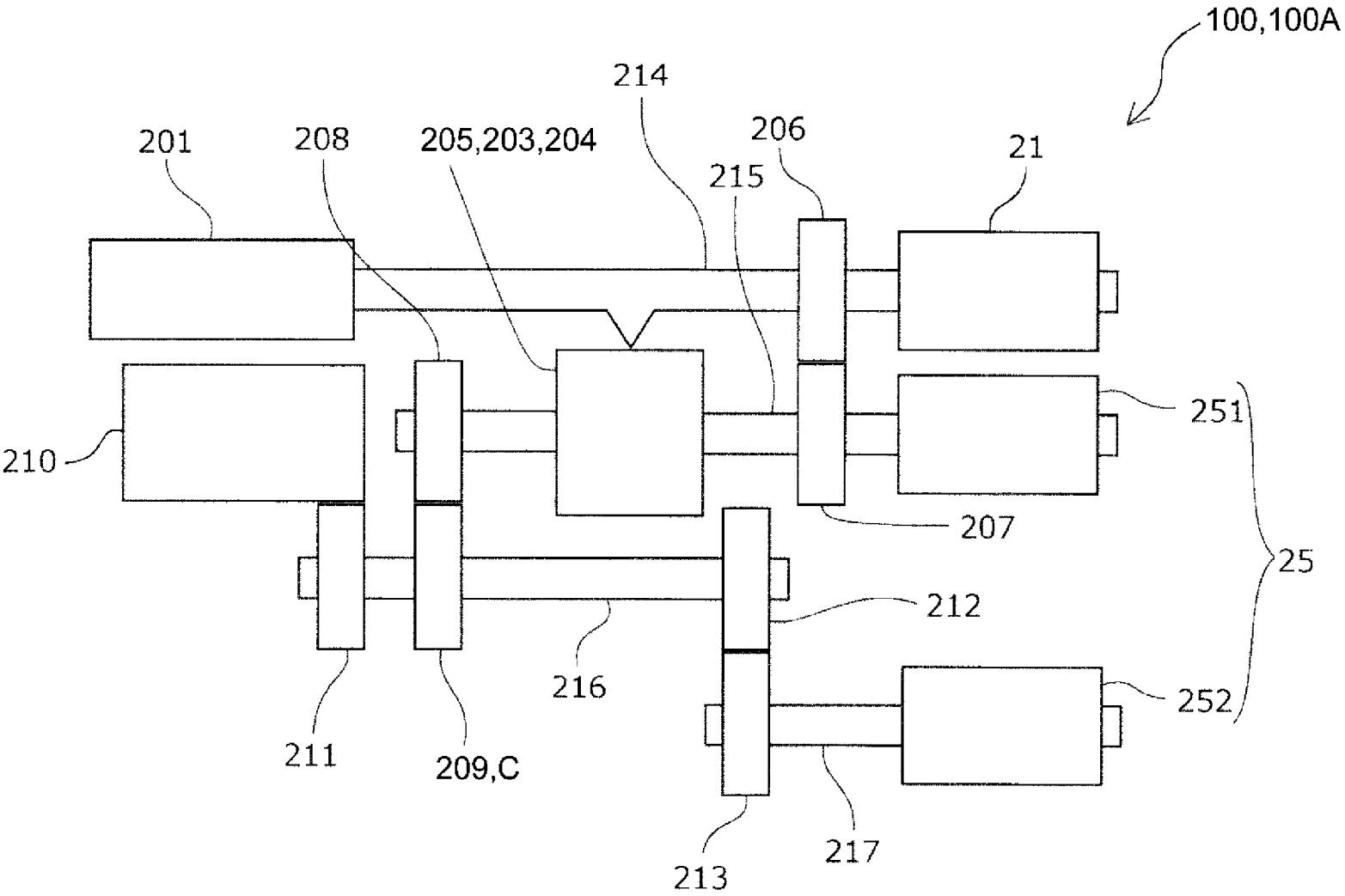
FIG. 6 is a block diagram of the drive mechanism section of the printer of FIG. 1.

As shown in FIG. 6 and the like, the drive mechanism section 100A of the present embodiment includes the feed roller pair 25. Here, the feed roller pair 25 includes a feed roller 251 that feeds the medium P from the first medium cassette 3 in a feed direction F1 in FIG. 1, and a separation roller 252 that nips the medium P together with the feed roller 251 and separates overlapped the plurality of medium P. The feed roller 251 is rotatable in a rotation direction R2*a*, which is a rotation direction in which the medium P move in the feed direction F1, by the driving force of the motor 210, as shown in a second diagram from the left of FIG. 11 and the like. The separation roller 252 is rotatable in a rotation direction R3*b*, which is a rotation direction in which the medium P moved in the reverse feed direction F2 toward the first medium cassette 3 opposite to the feed direction F1, by the driving force of the motor 210, as shown in a rightmost diagram of FIG. 11. However, the separation roller 252 is provided with a torque limiter, and when the torque exceeds a upper limit of the torque limiter, the separation roller 252 does not follow the rotation of the rotation shaft 217. As shown in the second diagram from the left of FIG. 11, when the feed roller 251 rotates in a rotational direction R2*a*, it is configured to exceed the upper limit of the torque limiter, and the separation roller 252 rotates in a rotational direction R3*a* following the rotation of the feed roller 251 in the rotational direction R2*a*.

Figure 11:
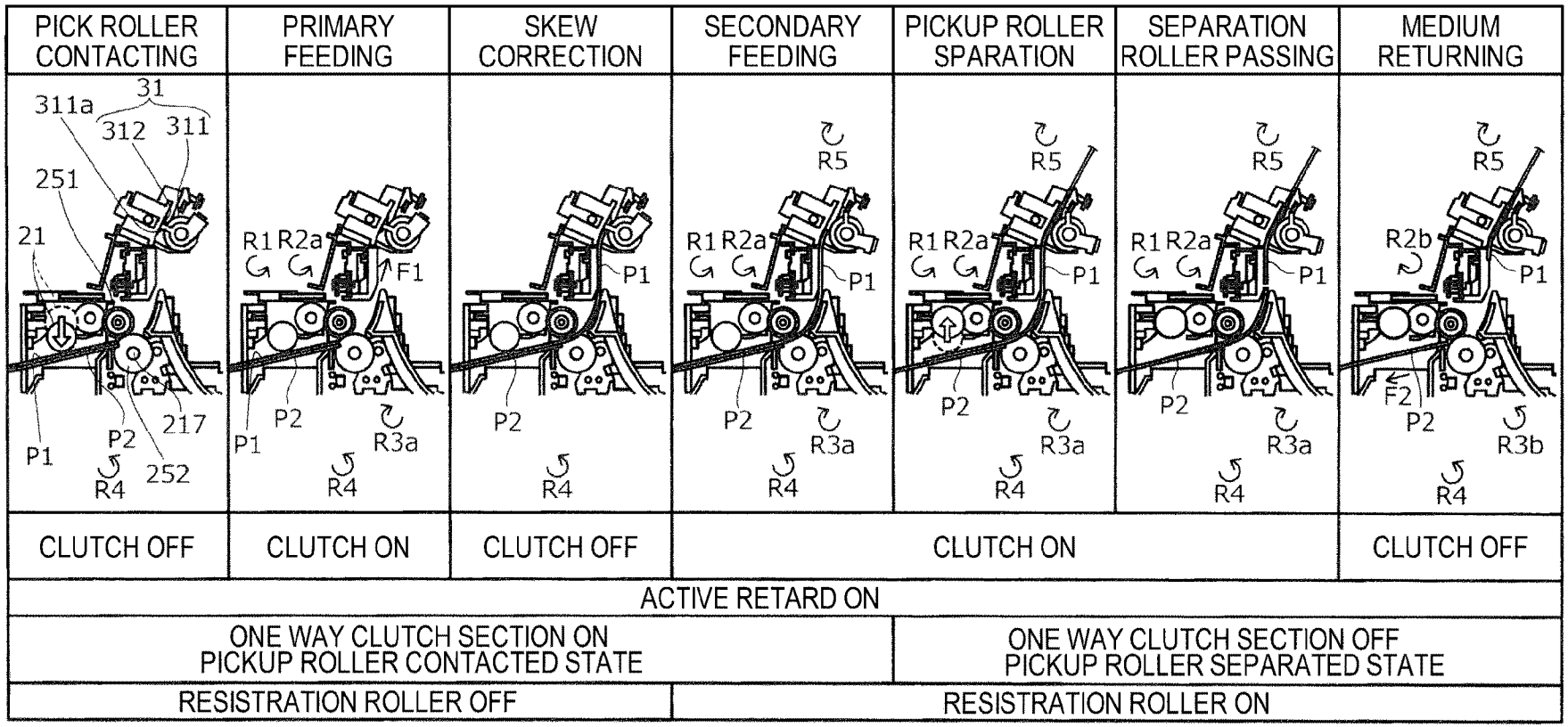
FIG. 11 is a schematic diagram for describing a feeding operation (medium multi-feed suppressing operation) as a medium transport method which can be executed in the printer of FIG. 1.

As shown in FIGS. 6, 11, and the like, the drive mechanism section 100A of the present embodiment includes, in addition to the pair of feed roller pair 25, the pickup roller 21 as a transport roller that is provided upstream of the feed roller 251 in the feed direction F1 and transports the medium P from the first medium cassette 3 toward the feed roller 251. Further, as shown in FIG. 11, the drive mechanism section 100A of the present embodiment includes a registration roller 311 and a driven roller 312 which constitute the transport roller pair 31 that also serving as role of the skew correction section. Here, the pickup roller 21 is rotatable in a rotation direction R1, which is the rotation direction in which the medium P move in the feed direction F1, by the driving force of the motor 210, as shown in the second diagram from the left of FIG. 11 and the like. The registration roller 311 is rotatable in a rotation direction R5 in which the medium P moves in the feed direction F1, by the driving force of the motor 210, as shown in the fourth diagram from the left of FIG. 11 and the like.

Describing in more detail with reference to FIG. 6, when the motor 210 is turned on in the drive mechanism section 100A of the present embodiment, a gear 211 attached to a rotation shaft 216 rotates, and the rotation shaft 216 also rotates with the rotation of the gear 211. A gear 209 and a gear 212 are attached to the rotation shaft 216, and the gear 209 and the gear 212 also rotate with the rotation of the rotation shaft 216. However, the gear 209 has a clutch C, and by turned off the clutch C, it is possible to prevent the gear 209 from rotating even in a state where the rotation shaft 216 is rotating.

The gear 212 is disposed at a position where the gear 212 meshes with a gear 213 attached to a rotation shaft 217 of the separation roller 252, and when the gear 212 rotates, the gear 213 also rotates, and further, the rotation shaft 217 and the separation roller 252 also rotate. A rotation direction of the rotation shaft 217 when the motor 210 is turned on is a rotation direction R4 in FIG. 11. The rotation direction R4 of the rotation shaft 217 corresponds to the rotation direction R3*b* of the separation roller 252, as shown in the rightmost diagram of FIG. 11.

As described above, the separation roller 252 is provided with the torque limiter. The torque limiter in the drive mechanism section 100A of the present embodiment houses a coil spring therein, and when the rotation shaft 217 rotates in the rotation direction R4, the separation roller 252 rotates together in the rotation direction R3*b*, but when an external force is applied to the separation roller 252 and this external force exceeds the upper limit of the torque limiter, the coil spring inside the torque limiter does not work effectively. That is, when the feed roller 251 is rotated in the rotational direction R2*a* by the driving force of the motor 210, the torque exceeds the upper limit of the torque limiter, so that the separation roller 252 is rotated in the rotational direction R3*a*. However, when the external force disappears, the coil spring springs back so as to return to the original shape, and the separation roller 252 rotates in the rotation direction R3*b*.

When the coil spring of the separation roller 252 springs back in a state where the medium P is nipped between the feed roller 251 and the separation roller 252, the medium P move in a reverse feed direction F2 opposite to the feed direction F1. When such a situation occurs, recording on the medium P during recording may be disturbed, the skew correction accuracy may be lowered, or the like. Therefore, in the drive mechanism section 100A of this embodiment, by performing separate transport using the feed roller pair 25 together with the transport roller pair 31 and the like on downstream in the feed direction F1 until the trailing edge of the medium P during recording passes through the separation roller 252, thereby suppresses disturbance of recording due to spring back of the torque limiter. When the plurality of medium P are transported, since there is a possibility that the subsequent medium P2 is fed consecutively with the preceding medium P1, the subsequent medium P2 is fed after the feeding of the preceding medium P1 is completed. For this reason, by turned off the clutch C of the gear 209 and switching the feed roller 251 to a freely rotatable state, the drive mechanism section 100A of the embodiment is configured to move the preceding medium P1 in the feed direction F1 and temporarily move the subsequent medium P2 in the reverse feed direction F2 by an active retard in which the motor 210 is kept driven.

Figure 2:
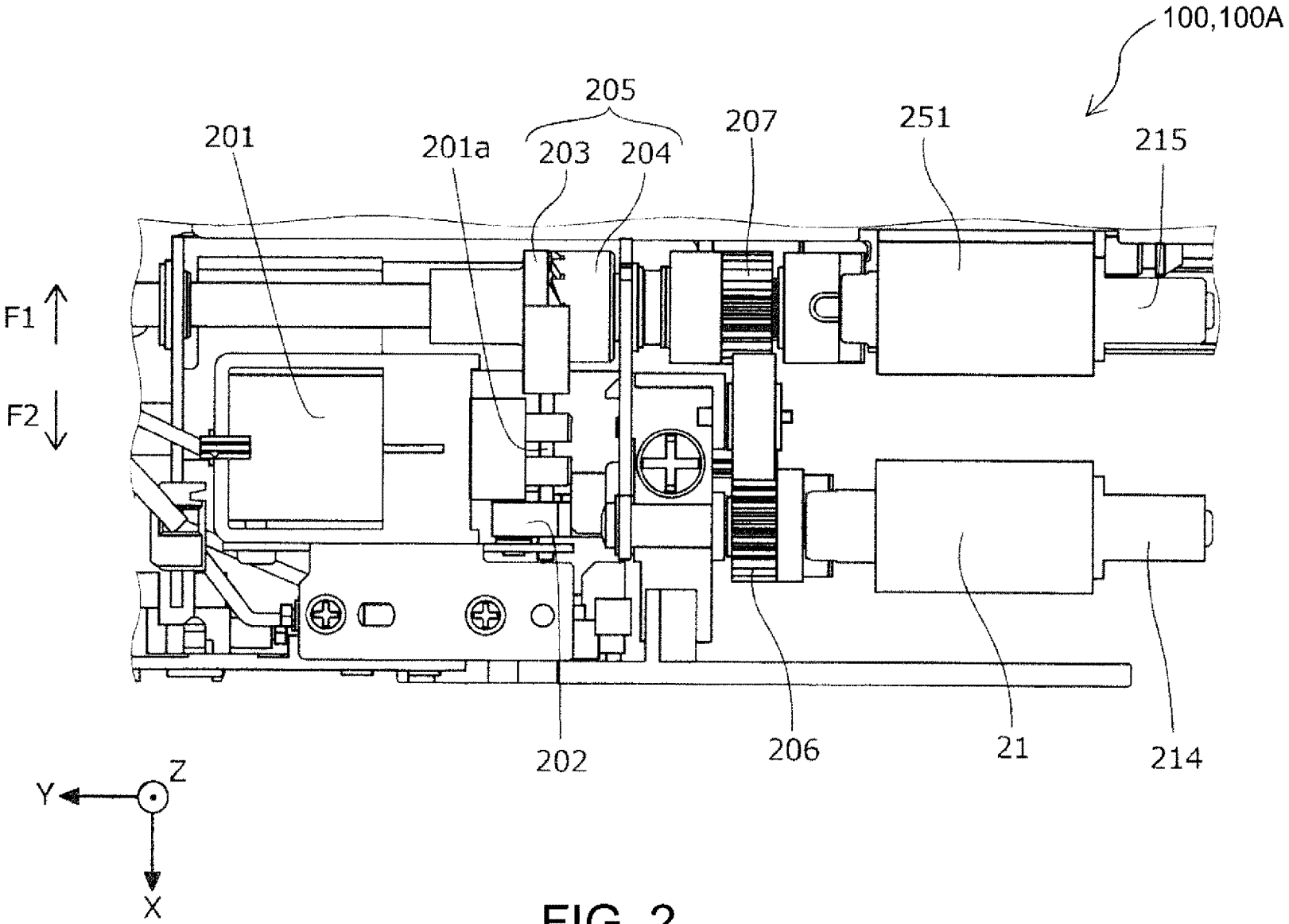
FIG. 2 is a plan view showing a drive mechanism section of the printer of FIG. 1, and is a diagram showing a state in which a one way clutch section is in a restricted state.
Figure 3:
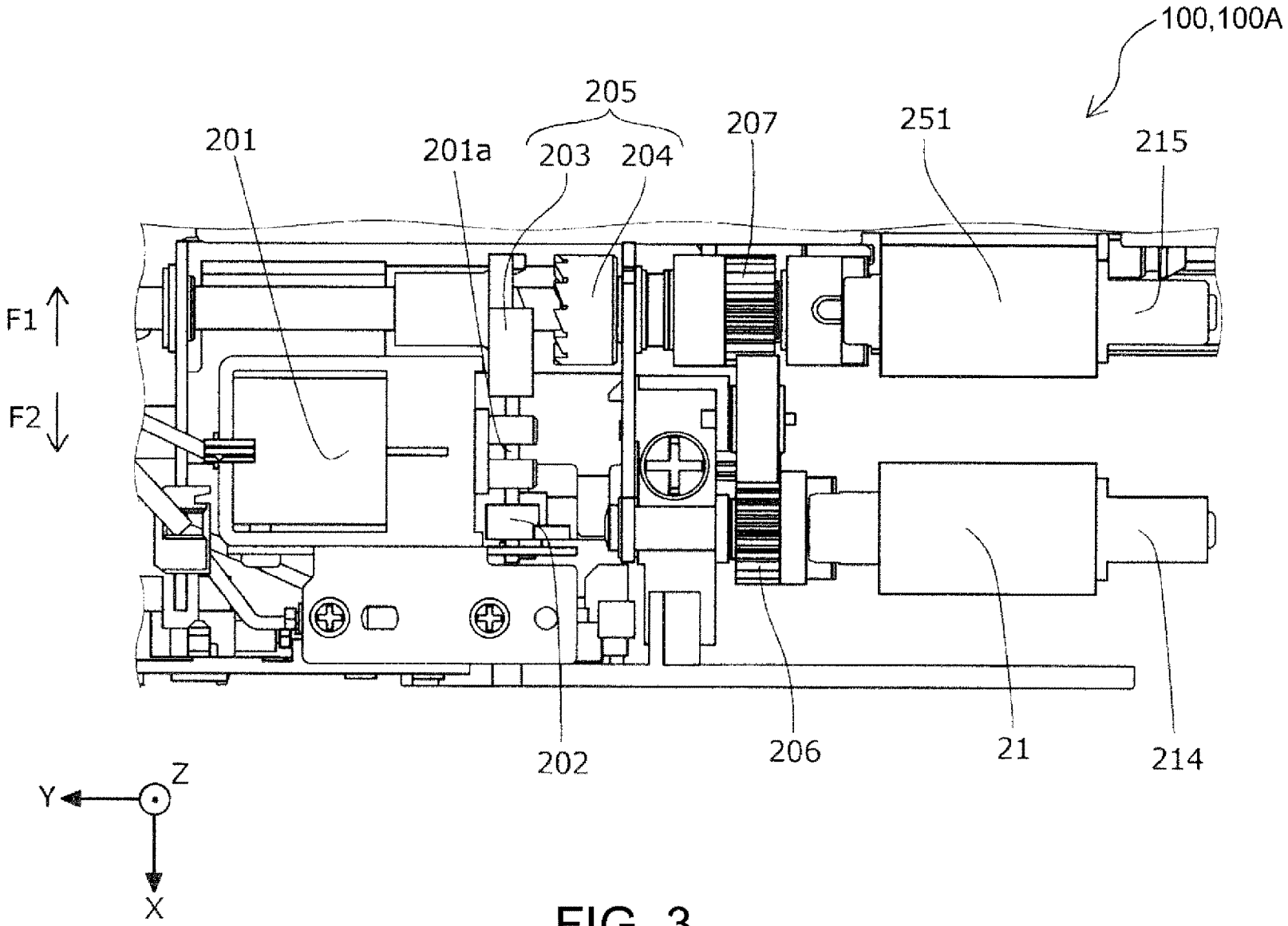
FIG. 3 is a plan view showing the drive mechanism section of the printer of FIG. 1, and is a diagram showing a state in which the one way clutch section is in a allowed state.
Figure 9:
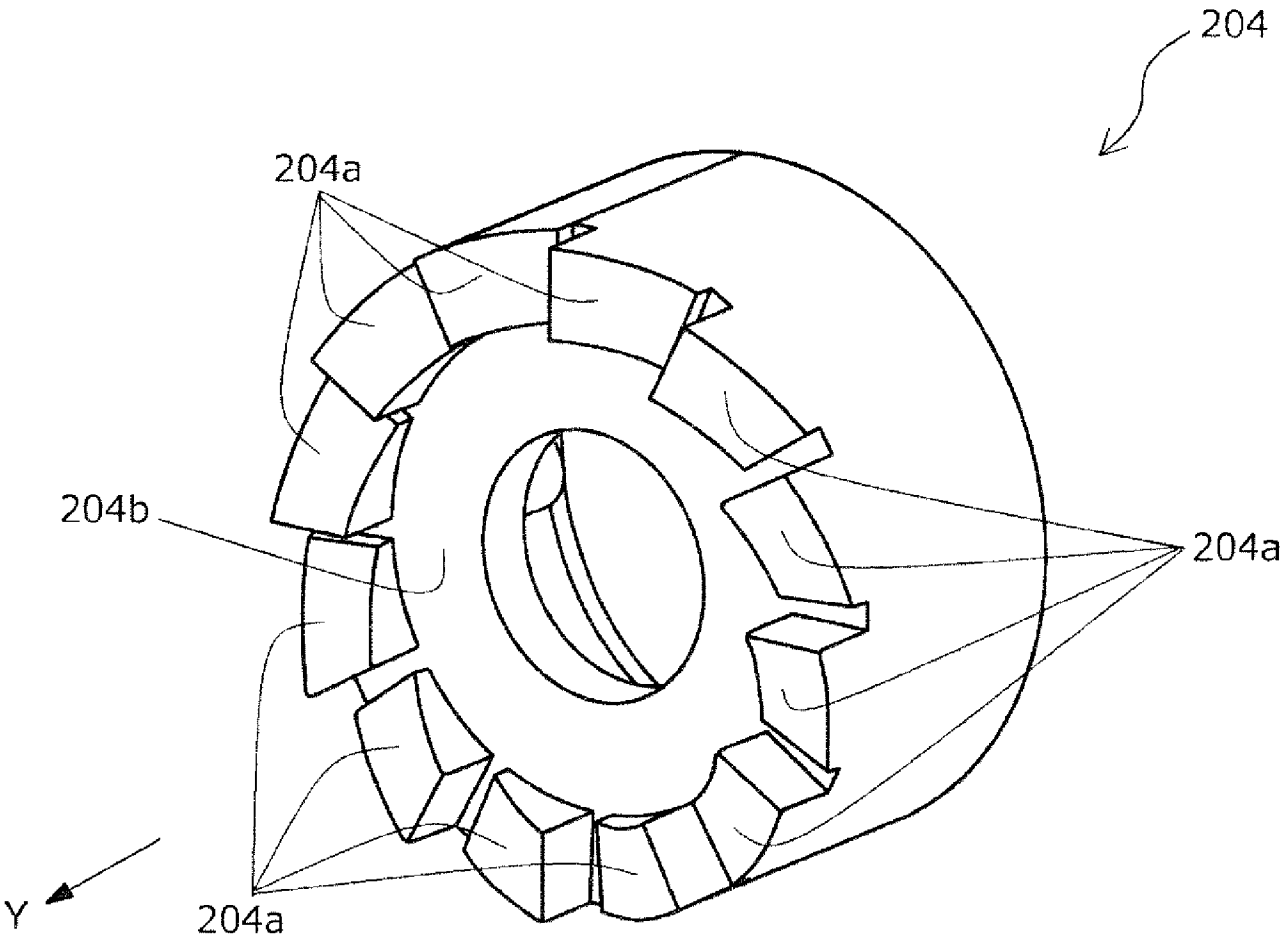
FIG. 9 is a perspective view showing a star ratchet of the one way clutch section of the printer of FIGS. 7 and 8.
Figure 10:
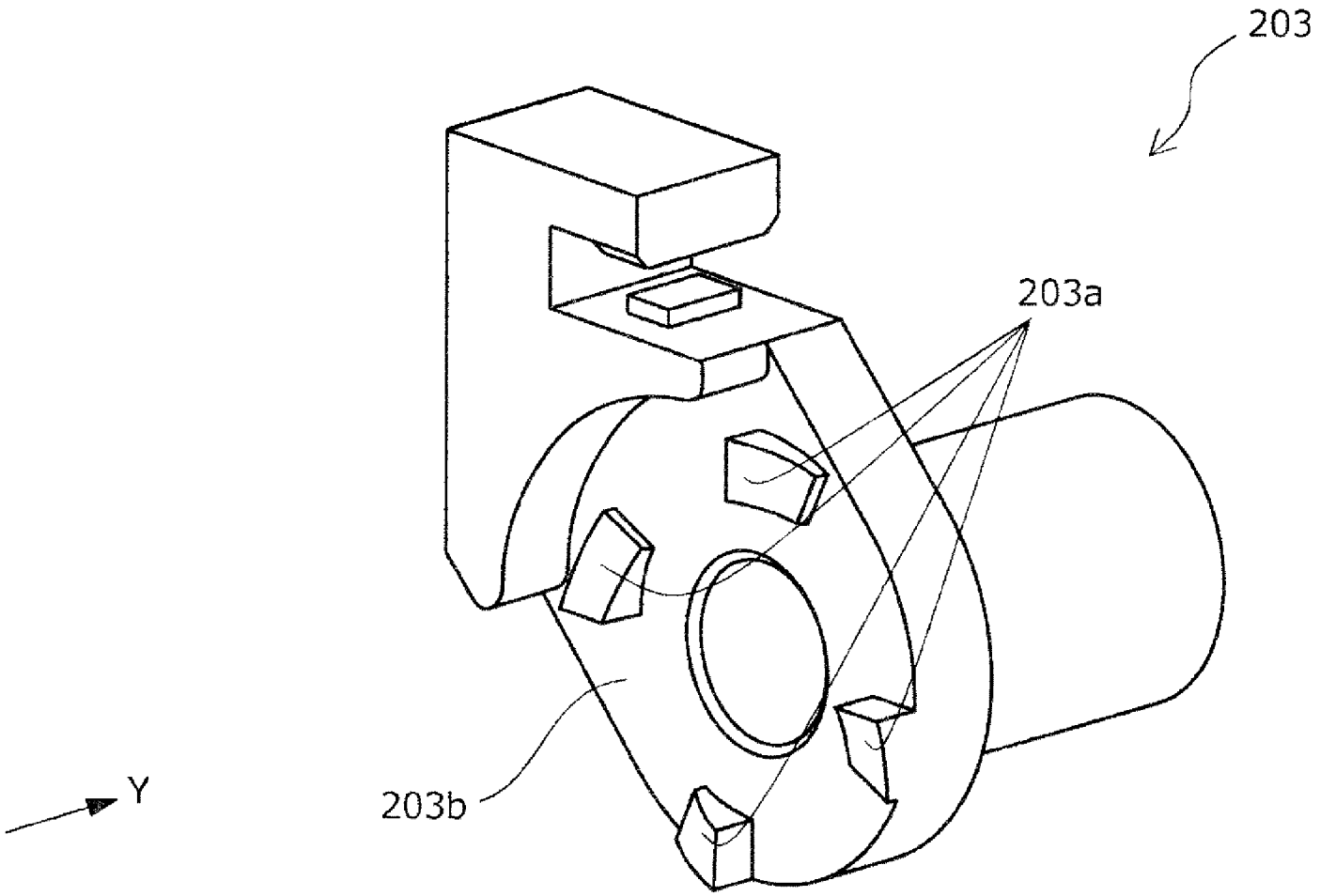
FIG. 10 is a perspective view showing a locking section of the one way clutch section of the printer of FIGS. 7 and 8.

More specifically, as shown in FIGS. 2, 3, and 6, the drive mechanism section 100A of the present embodiment includes an one way clutch section 205 including a locking section 203 shown in detail in FIG. 10 and a star ratchet 204 shown in detail in FIG. 9 on the rotation shaft 215 of the feed roller 251. The drive mechanism section 100A of the present embodiment by turning on or off the one way clutch section 205, switches the one way clutch section 205 between a restricted state in which the one way clutch section 205 restricts the rotation of the feed roller 251 in the rotation direction R2*b* shown in the rightmost diagram of FIG. 11 in which the medium P move in the reverse feed direction F2 opposite to the feed direction F1 and a allowed state in which the feed roller 251 is freely rotatable and the rotation in the rotation direction R2*b* is allowed. Furthermore, the feed roller 251 transports the medium P by a predetermined amount in the restricted state of the one way clutch section 205, and performs skew correction by abutting the medium P against the registration roller 311 and a gate member 311*a* provided in the registration roller 311. At this time, the clutch C of the gear 209 is in the off state, but since the one way clutch section 205 is in the restricted state, the rotation of the rotation shaft 215 in a medium returning direction in which the medium P move in the reverse feeding direction F2 due to the spring back of the torque limiter is suppressed, and a decrease in the skew correction accuracy is suppressed. As described above, the drive mechanism section 100A of the present embodiment is configured to switch between the restricted state and the allowed state by turning on or off the one way clutch section 205. As a result, when the plurality of medium P are transported, it is possible to appropriately feed the subsequent medium P2 that has been temporarily returned after the feeding of the preceding medium P1 is completed, and it is possible to suppress the recording disturbance in the medium P during recording and the lowering of the skew correction accuracy. In addition, the drive mechanism section 100A of the present embodiment is set to the restricted state by turned on the one way clutch section 205, and further, by turned off the clutch C of the gear 209, it is possible to suppress the return of the medium at the time of skew correction due to the spring back of the torque limiter without stopping the driving of the motor 210.

As shown in FIGS. 2 to 6, the drive mechanism section 100A of the present embodiment includes the pickup roller 21, and a gear 206 provided on the rotation shaft 214 of the pickup roller 21 is meshed with a gear 207 provided on the rotation shaft 215 of the feed roller 251 via another gear. Therefore, the pickup roller 21 and the feed roller 251 can rotate in conjunction with each other. As shown in FIG. 6, the rotation shaft 215 is provided a gear 208 meshed with the gear 209 and the one way clutch section 205, and the driving force of the motor 210 is transmitted to the feed roller 251 and the pickup roller 21 via the gear 209 and the gear 208. However, as described above, since the gear 209 has the clutch C, it is also possible not to transmit the driving force of the motor 210 to the feed roller 251 and the pickup roller 21 by turned off the clutch C of the gear 209.

Figure 4:
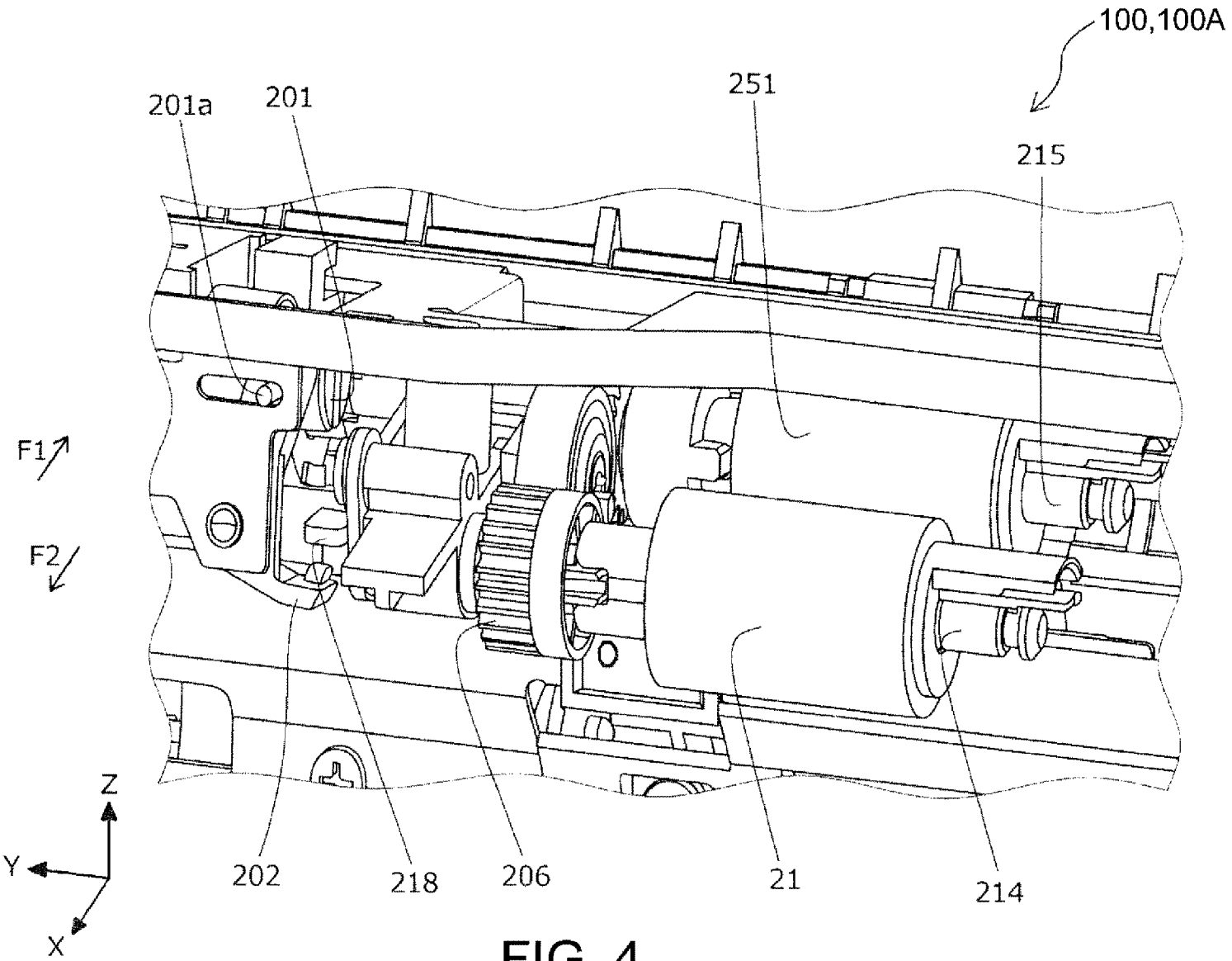
FIG. 4 is a perspective view showing the drive mechanism section of the printer of FIG. 1, and is a diagram showing a state in which the one way clutch section is in the restricted state.
Figure 5:
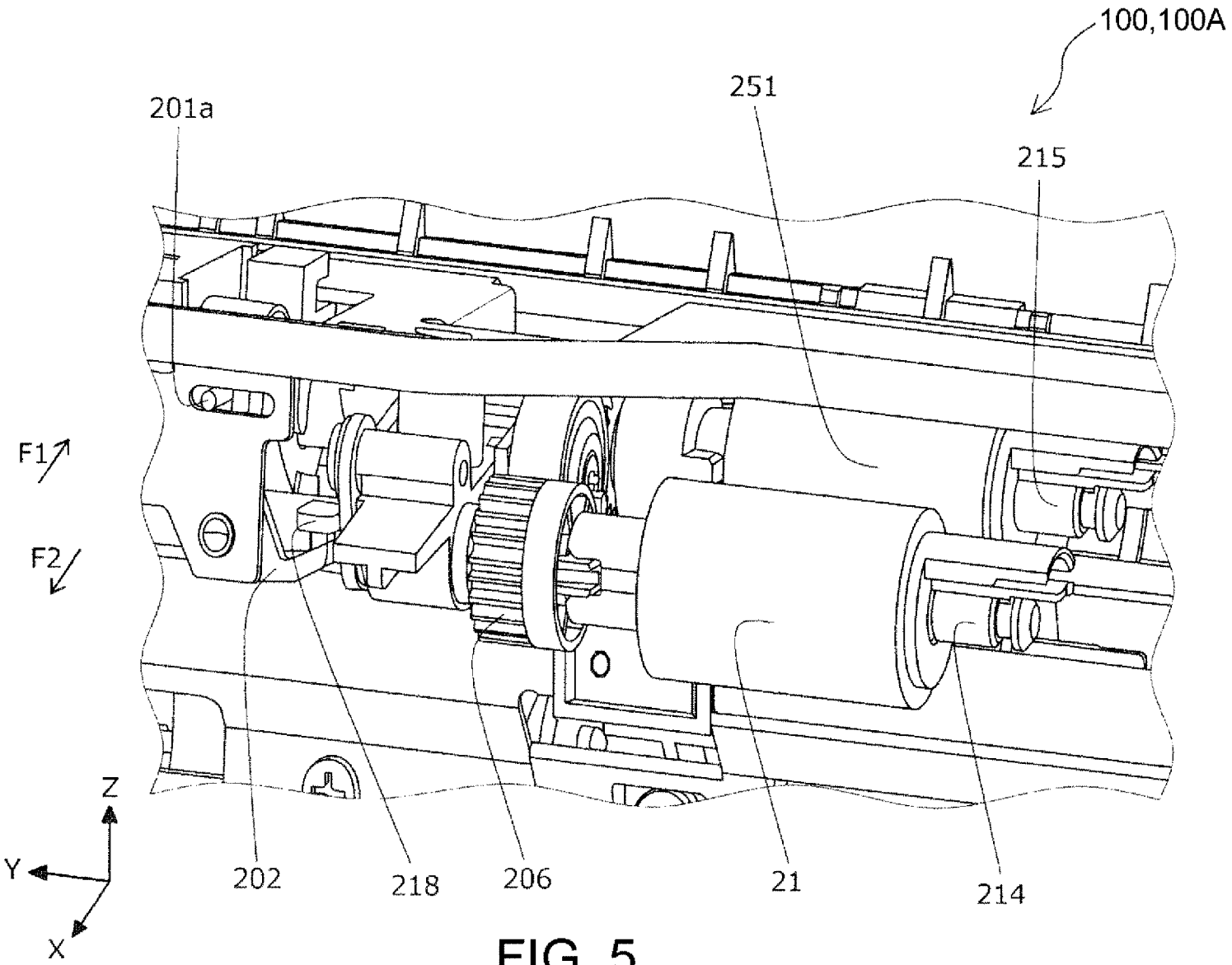
FIG. 5 is a perspective view showing a drive mechanism section of the printer of FIG. 1, and is a diagram showing a state in which the one way clutch section is in the allowed state.

Further, as shown in FIGS. 2 to 6, the drive mechanism section 100A of the present embodiment includes a solenoid 201. Further, as shown in FIGS. 2 and 3, a shaft section 201*a* is attached to the solenoid 201, and the locking section 203 of the one way clutch section 205 and the pickup roller separation cam 202 are attached to the shaft section 201*a*. By the solenoid 201 moves the shaft section 201*a* along the −Y direction, the one way clutch section 205 is turned on as shown in FIG. 2, and by the pickup roller separation cam 202 moves downward to a position at which it does not in contact with the contact section 218 as shown in FIG. 4, so that the pickup roller separation cam 202 moves the pickup roller 21 downward to a position at which the pickup roller 21 can in contact with the medium P. On the other hand, by the solenoid 201 moves the shaft section 201*a* along the +Y direction, the one way clutch section 205 is turned off as shown in FIG. 3, and by the pickup roller separation cam 202 contact with the contact section 218 and moves upward together with the contact section 218 as shown in FIG. 5, so that the pickup roller separation cam 202 moves the pickup roller 21 upward to a position at which the pickup roller 21 does not in contact the medium P.

In the drive mechanism section 100A of the present embodiment, both the feed roller 251 and the pickup roller 21 are provided above the feed path TO. Therefore, it is possible to dispose the feed roller 251 and the pickup roller 21 can be arranged close to each other, and with such a configuration, it is easy to switch the pickup roller separation cam 202 and the one way clutch section 205 which are the separation mechanism of the pickup roller 21 by the solenoid 201 which is the same actuator, and it is possible to miniaturize the printer 1.

Figure 7:
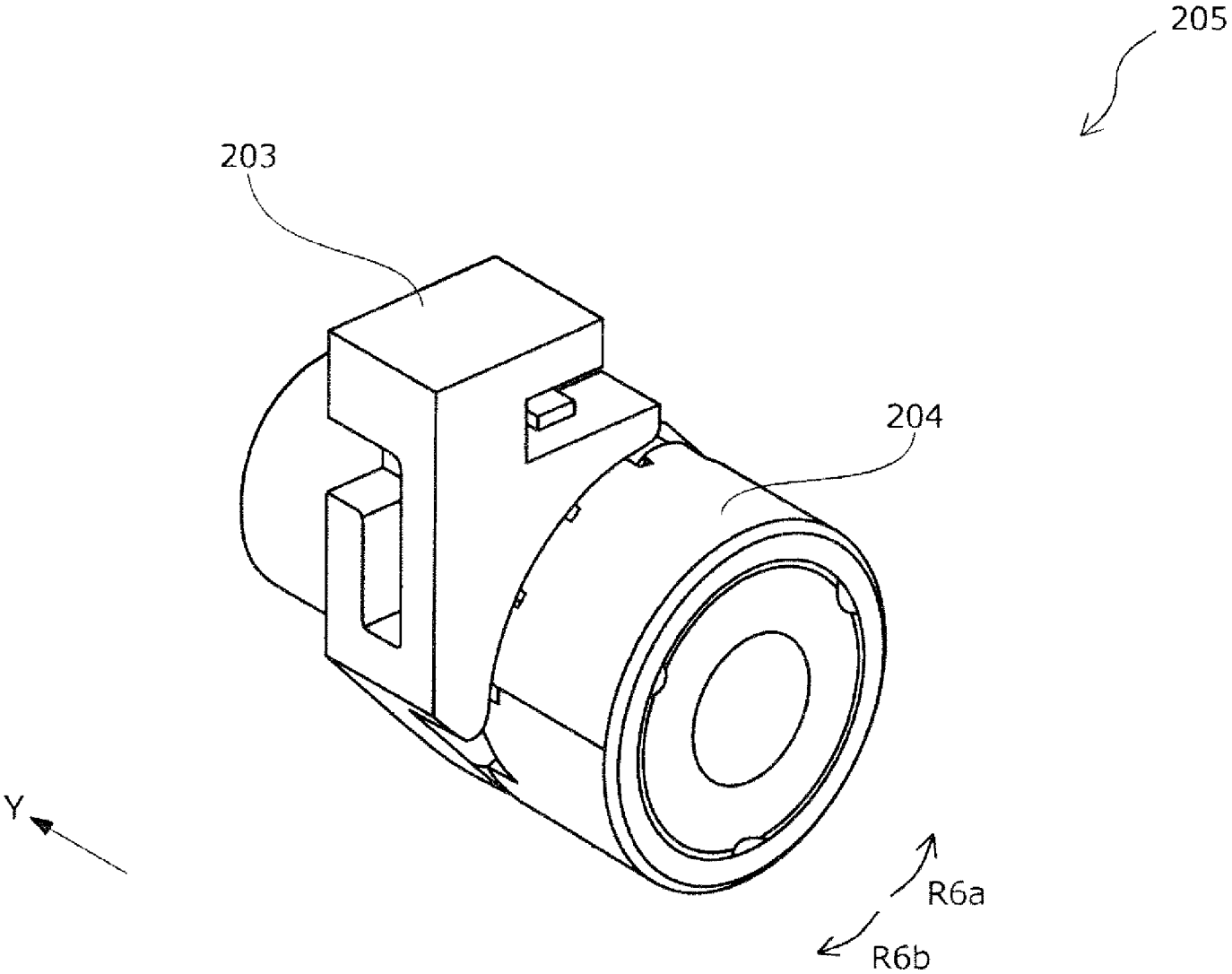
FIG. 7 is a perspective view showing the one way clutch section of the printer of FIG. 1, and is a diagram showing a state in which the one way clutch section is in the restricted state.
Figure 8:
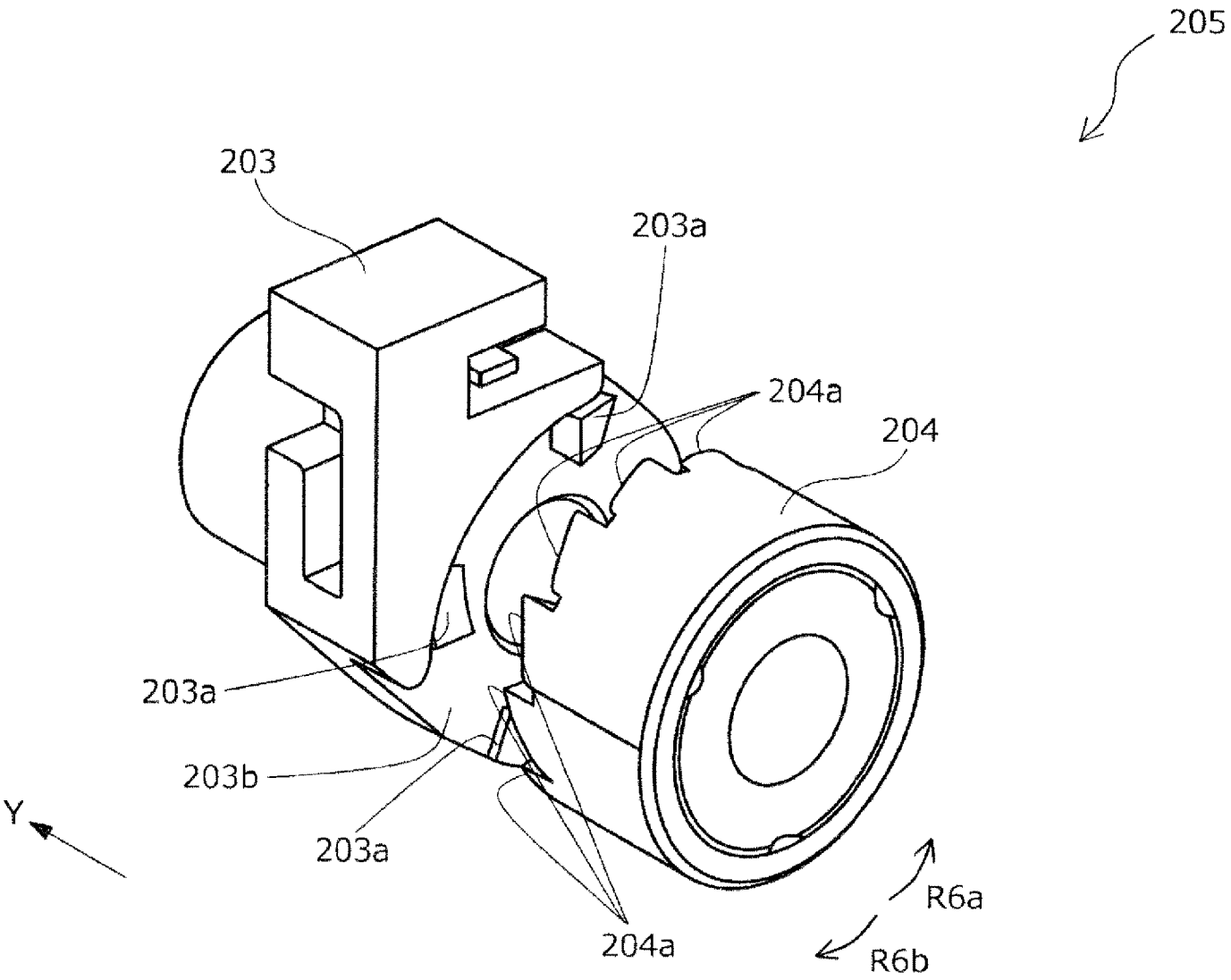
FIG. 8 is a perspective view showing the one way clutch section of the printer of FIG. 1, and is a diagram showing a state in which the one way clutch section is in the allowed state.

Here, a detailed configuration of the one way clutch section 205 will be described with reference to FIGS. 7 to 10. As shown in FIGS. 7 and 8, the one way clutch section 205 of the present embodiment has the star ratchet 204 shown in FIG. 9 and the locking section 203 shown in FIG. 10. As shown in FIGS. 7 and 8, the star ratchet 204 and the locking section 203 are faced to each other in the Y-axis direction, tooth 204*a* protruding in the +Y direction are formed in the vicinity of the periphery of the facing surface 204*b* of the star ratchet 204, and protrusion sections 203*a* engaging with the tooth 204*a* protruding in the −Y direction is formed in the vicinity of the periphery of the facing surface 203*b* of the locking section 203.

Here, the locking section 203 is configured to be move along the Y-axis direction by the solenoid 201, but is configured not to rotate about the Y-axis direction as a rotation axis by being in contact with a frame (not shown) or the like. On the other hand, as shown in FIG. 7, when the one way clutch section 205 is in the on state, the star ratchet 204 is configured to be freely rotate in a rotation direction R6*a* with respect to the locking section 203 with the Y-axis direction as the rotational axis, but not freely rotate in a rotation direction R6*b* with respect to the locking section 203. This is because the tooth 204*a* are configured to be gradually lower in the +Y direction in the rotation direction R6*a*, and the protrusion sections 203*a* are configured to be gradually higher in the −Y direction. Therefore, when the star ratchet 204 rotates in the rotation direction R6*a* with respect to the locking section 203, the tooth 204*a* are not caught on the protrusion sections 203*a*, but when the star ratchet 204 rotates in the rotation direction R6*b* with respect to the locking section 203, the tooth 204*a* are caught on the protrusion sections 203*a*. That is, when the one way clutch section 205 is in the on state as shown in FIG. 7, the star ratchet 204 becomes freely rotatable only in the rotation direction R6*a* with respect to the locking section 203. As shown in FIG. 8, when the one way clutch section 205 is in the off state, the tooth 204*a* are not in contact with the protrusion sections 203*a*, so that the star ratchet 204 becomes freely rotatable in both the rotational direction R6*a* and the rotational direction R6*b* with respect to the locking section 203.

Figure 12:
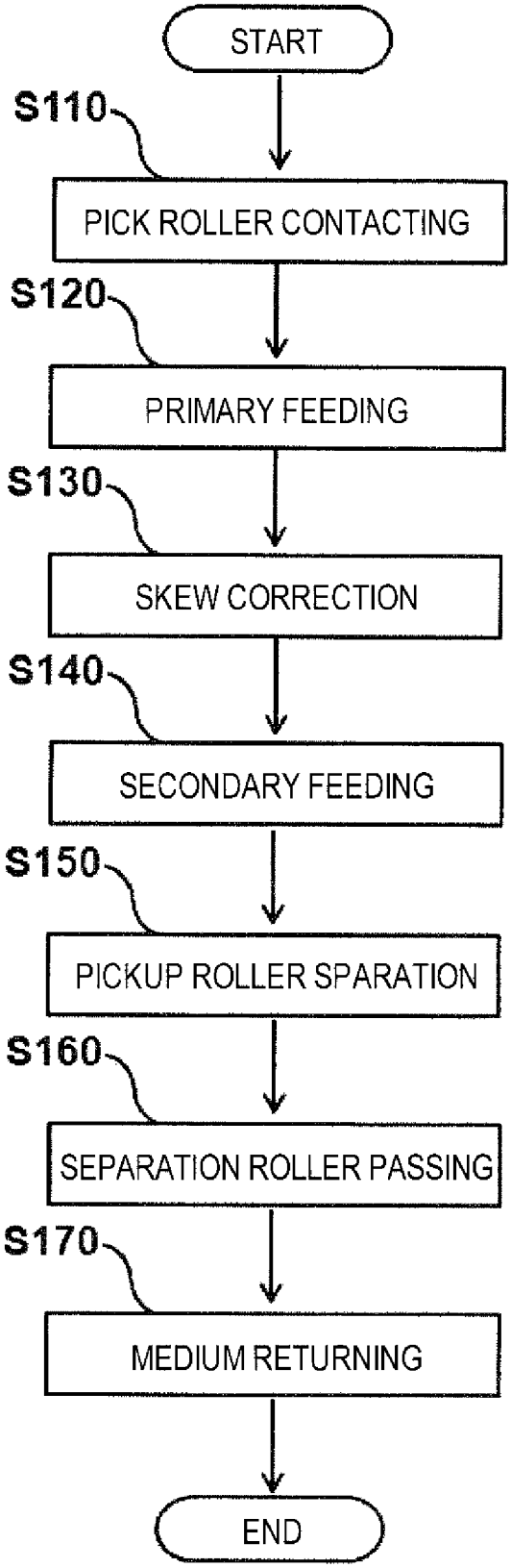
FIG. 12 is a flowchart of the feeding operation (medium multi-feed suppressing operation) as the medium transport method which can be executed in the printer of FIG. 1.

Next, with reference to FIGS. 11 and 12, an example of a feeding operation as a medium transport method that can be executed by the printer 1 of the present embodiment will be described. By turned on the motor 210 and turned on the active retard, when the medium transport method of the present embodiment is started, first, as shown in FIG. 12, a pickup roller contacting step of step S110 is executed.

In the pickup roller contacting step of step S110, by turned on the solenoid 201, the pickup roller 21 is brought to contact against the medium P. By the solenoid 201 is turned on, the one way clutch section 205 is turned on, and the feed roller 251 does not freely rotate in the rotation direction R2*b*. The leftmost diagram of FIG. 11 shows the state of the drive mechanism section 100A at the time of starting the execution of the pickup roller contacting step of step S110. In this state, the clutch C of the gear 209 is off, the motor 210 is on, the one way clutch section 205 is on, the registration roller 311 is in a state of not rotating, and the rotation shaft 217 is in a state of rotating in the rotation direction R4. Note that the pickup roller 21 and the feed roller 251 are in a state of not rotating, and the feed roller 251 is in a state of not freely rotating in the rotation direction R2*b*, so that the separation roller 252 contacting to the feed roller 251 is also in a state of not rotating.

Next, in a primary feeding step of step S120, the clutch C of the gear 209 is turned on. As a result, the pickup roller 21 rotates in the rotation direction R1, and the feed roller 251 rotates in the rotation direction R2*a*, as shown in the second diagram from the left of FIG. 11. Note that, although the rotation shaft 217 is in a state of rotating in the rotation direction R4, the separation roller 252 rotates in the rotation direction R3*a* in accordance with the rotation of the feed roller 251. The preceding medium P1 among the medium P is fed by executing the primary feeding step of step S120.

Next, in a skew correction step of step S130, as shown in the third diagram from the left of FIG. 11, the leading edge of the preceding medium P1 is abutted against the registration roller 311 and the gate member 311*a* provided on the registration roller 311 to perform skew correction. The printer 1 of the present embodiment includes a medium sensor (not shown), and turns off the clutch C of the gear 209 after determining that the leading edge of the preceding medium P1 has abutted against the registration roller 311 and the gate member 311*a* for a predetermined time using the detection result of the medium sensor. By the clutch C of the gear 209 is turned off, the pickup roller 21 and the feed roller 251 are in a state of not rotated by the driving force of the motor 210. Since the one way clutch section 205 is in the restricted state by the turned on of the one way clutch section 205, the feed roller 251 is in a state of not freely rotate in the rotation direction R3*b*, and the separation roller 252 in contact with the feed roller 251 is in a state of not rotated in the rotation direction R3*b* although the rotation shaft 217 is in a state of rotated in the rotation direction R4, and the return of the preceding medium P1 due to the spring back of the torque limiter is suppressed. In this way, the leading edge of the preceding medium P1 is abutted against the registration roller 311 and the gate member 311*a* for the predetermined time, so that the leading edge of the preceding medium P1 follows the registration roller 311 and the gate member 311*a*, and the skew is corrected.

Next, in a secondary feeding step of Step S140, as shown in the fourth diagram from the left of FIG. 11, the registration roller 311 is rotated in the rotation direction R5, and the clutch C of the gear 209 and is turned on. By the clutch C of the gear 209 is turned on, the pickup roller 21 rotates in the rotation direction R1, and the feed roller 251 rotates in the rotation direction R2*a*. The separation roller 252 rotates in the rotation direction R3*a* as the feed roller 251 rotates. The preceding medium P1 among the medium P is further fed by executing the secondary feeding step of the step S140.

Next, in a pickup roller separation step of step S150, the pickup roller 21 is separated from the medium P as shown in the fifth diagram from the left of FIG. 11. Specifically, the pickup roller 21 is separated from the medium P by turned off the solenoid 201. By the solenoid 201 is turned off, the one way clutch section 205 is turned off, and the one way clutch section 205 is brought into the allowed state. In the pickup roller separation step of step S150, the registration roller 311 rotates in the rotation direction R5, so that the preceding medium P1 among the medium P is further fed, but at this time, the feeding by the pickup roller 21 is stopped.

Next, in a separation roller passing step of step S160, as shown in the sixth diagram from the left of FIG. 11, the preceding medium P1 is fed by continuing the state in which the clutch C of the gear 209 is turned on until the trailing edge of the preceding medium P1 passes the nip position between the feed roller 251 and the separation roller 252. Although recording has already been started near the leading edge of preceding medium P1 before the start of the separation roller passing step of step S160, prevents force from being applied to the preceding media P1 in the reverse feeding direction F2 by the feed roller pair 25 due to the preceding media P1 not being fed by the feed roller 251 during recording. This is because, when force is applied in the reverse feed direction F2 by the feed roller pair 25 during recording, the transport speed of the medium P suddenly changes, and band-like unevenness or the like may occur in a recorded image. A detection result of the medium sensor (not shown) or the like can be used to detect that the trailing edge of the preceding medium P1 has passed through the nip position between the feed roller 251 and the separation roller 252.

Finally, in a medium returning step of step S170, as shown in the rightmost diagram of FIG. 11, the subsequent medium P2 fed in the feed direction F1 subsequent to the preceding medium P1 in the separation roller passing step of step S160 is returned in the reverse feed direction F2. Specifically, the clutch of the gear 209 is turned off. By the clutch of the gear 209 is turned off, the driving force of the motor 210 is not transmitted to the feed roller 251. On the other hand, since the motor 210 is continuously turned on from the step S110 to the step S170, the rotation shaft 217 of the separation roller 252 is in a state of continuously rotated in the rotation direction R4. Since the driving force of the motor 210 is no longer transmitted the feed roller 251, the rotational force is not transmitted from the feed roller 251 to the separation roller 252. Further, the feed roller 251 is in a freely rotatable state in the rotation direction R3*b*. On the other hand, since the rotation shaft 217 of the separation roller 252 is continuously rotated in the rotation direction R4, the separation roller 252 is rotated in the rotation direction R3*b* in accordance with the rotation of the rotation shaft 217, and the feed roller 251 is rotated in the rotation direction R2*b* in accordance therewith. Therefore, the subsequent medium P2 in nipped state between the feed roller 251 and the separation roller 252 returns in the reverse feed direction F2. In a case where the subsequent medium P2 is fed again, each flow of the flowchart is repeated from step S110 to step S170.

As described above, the drive mechanism section 100A in the present embodiment includes the motor 210 as the drive section for generating the driving force and the one way clutch section 205 provided in the transmission path for transmitting the driving force to the feed roller 251. Here, the one way clutch section 205 can be switched between the allowed state in which the feed roller 251 is allowed to rotate in the rotation direction R2*b* in which the medium P is moved in the reverse feed direction F2 and the restricted state in which the feed roller 251 is allowed to rotate only in the rotation direction in which the medium P are moved in the feed direction F1. The drive mechanism section 100A of the present embodiment is configured to set the one way clutch section 205 to the allowed state and rotating the separation roller 252 in the rotation direction R3*b* in which the medium P moves in the reverse feed direction F2. Since the drive mechanism section 100A of the present embodiment has such a configuration, it is possible to appropriately return the subsequent medium P2 subsequent to the preceding medium P1 to the first medium cassette 3 side while suppressing the subsequent medium P2 from being blown off with great force to the placement section side to the placement section side after the preceding medium P1 passes through the nip position between the feed roller 251 and the separation roller 252.

The present embodiment is the active retard in which the rotation shaft 217 of the separation roller 252 continues to rotate in the rotation direction R4 in which the medium P are moved in the reverse feed direction F2 as the motor 210 is turned on as described above, but is not limited to such a configuration. The motor 210 may be driven to rotate the separation roller 252 when the subsequent medium P2 subsequent to the preceding medium P1 is returned to the first medium cassette 3, or the separation roller 252 may be connected to the motor 210 that rotates the separation roller 252 when the subsequent medium P2 subsequent to the preceding medium P1 is returned to the first medium cassette 3.

Further, by using the printer 1 of the present embodiment, it is possible to execute, as the medium multi-feed suppressing operation, the medium transport method for performing the feeding step of feeding the medium P in the feed direction F1 while nipping the medium P between the feed roller 251 and the separation roller 252, corresponding to steps S120 and S140, and a subsequent medium returning step of returning the subsequent medium P2 among the medium P subsequent the preceding medium P1 transported in the feeding step to the reverse feed direction F2, corresponding to step S170, by rotating the separation roller 252 in the rotation direction R3*b* in which the medium P moves in the reverse feed direction F2 while the one way clutch section 205 is in the allowed state. By executing such a medium transport method, it is possible to appropriately return the subsequent medium P2 subsequent the preceding medium P1 to the first medium cassette 3 side while suppressing the subsequent medium P2 from being blown off with great force to the first medium cassette 3 side after the preceding medium P1 has passed through the nip position between the feed roller 251 and the separation roller 252.

Also, as above, the printer 1 according to the present embodiment includes the pickup roller 21 as the transport roller that is provided upstream of the feed roller 251 in the feed direction F1 and transports the medium P from the first medium cassette 3 toward the feed roller 251. The drive mechanism section 100A of the present embodiment has the solenoid 201 as the switching section for switching the pickup roller 21 between the contacted state in which the pickup roller 21 is in contact with the medium P and the separated state in which the pickup roller 21 is separated from the medium P, so that the driving force can be transmitted to the pickup roller 21, and the one way clutch section 205 can be switched between the restricted state and the allowed state by the switching operation of the solenoid 201 between the restricted state and the allowed state. That is, the printer 1 of the embodiment can switch the state of the one way clutch section 205 between the restricted state and the allowed state by using the force for switching the state of the pickup roller 21. For this reason, the printer 1 of the present embodiment can simplify the device configuration.

Further, as described above, the drive mechanism section 100A of this embodiment brings the one way clutch section 205 into the restricted state when the solenoid 201 brings the pickup roller 21 into the contacted state corresponding to FIGS. 2 and 4, and brings the one way clutch section 205 into the allowed state when the solenoid 201 brings the pickup roller 21 into the separated state corresponding to FIGS. 3 and 5. For this reason, as shown in the rightmost diagram of FIG. 11, the printer 1 of the embodiment can suppress the leading edge of the subsequent medium P2 in the reverse feed direction F2 from being caught by the pickup roller 21 and jam or skew from occurring by setting the pickup roller 21 to the separated state when returning the subsequent medium P2 subsequent the preceding medium P1 to the first medium cassette 3 side.

Further, as described above, the one way clutch section 205 of the drive mechanism section 100A of the present embodiment has the star ratchet 204 provided with teeth for locking so as to allow rotation in one direction and disable rotation in the other direction. By configuring the one way clutch section 205 in this manner, the drive mechanism section 100 can be downsized, and the printer 1 can be downsized. Note that the star ratchet 204 of the present embodiment have a configuration in which the tooth 204*a* protrude in the direction along the rotation shaft 215, and by adopting such a configuration, both the star ratchet 204 and the locking section 203 can be made particularly compact in the direction, which intersects the rotation shaft 215.

In addition, as described above, the printer 1 according to the present embodiment includes the transport roller pair 31 as the skew correction section which is provided on downstream of the feed roller 251 in the feed direction F1, contacts to the medium P, and corrects the skew of the medium P. When the medium P fed by the feed roller 251 in contact with the registration roller 311 of the transport roller pair 31 and the gate member 311*a*, the drive mechanism section 100A of the present embodiment brings the one way clutch section 205 into the restricted state and interrupts the transmission of the driving force from the motor 210 to the feed roller 251 as shown in the third diagram from the left of FIG. 11. With such a configuration, it is possible to prevent the preceding medium P1 from being damaged or jammed due to continuous application of force to feeding the preceding medium P1 in the feed direction F1 after the preceding medium P1 contacts with the skew correction section.

As described above, the printer 1 according to the present embodiment includes the transport roller pair 31 which transports the medium P as the skew correction section, and when the medium P of which the skew is corrected by the transport roller pair 31 is transported by the transport roller pair 31, the solenoid 201 switches the pickup roller 21 from the contacted state to the separated state as shown in the fifth diagram from the left of FIG. 11. That is, in the printer 1 of the embodiment, when the medium P that the skew has been corrected is transported by the transport roller pair 31, the medium P is not transported by the pickup roller 21. In this way, by reducing the number of transport sections that are concerned with the transport of the medium P, the transport load can be reduced. In the present embodiment, the pickup roller 21 is switched from the contacted state to the separated state in synchronization with the timing at which the medium P starts to be transported by the transport roller pair 31, but these timings may be shifted from each other.

In addition, as described above, the printer 1 according to the present embodiment includes the line head 51 as the recording section which is provided on downstream of the transport roller pair 31 in the feed direction F1 and performs recording on the medium P. Then, as shown in the sixth diagram from the left of FIG. 11, the drive mechanism section 100A of the present embodiment continues the transmission of the driving force from the motor 210 to the feed roller 251 until the trailing edge in the feed direction F1 of the medium P on which recording is performed by the line head 51 passes through the nip position between the feed roller 251 and the separation roller 252. When the driving force is no longer transmitted to the feed roller 251 before the medium P passes through the nip position between the feed roller 251 and the separation roller 252 in a state in which recording is being performed by the recording section, the transport distance per unit time may suddenly change, and the recording quality may deteriorate. However, in the printer 1 of the present embodiment, the drive mechanism section 100A continues the transmission of the driving force from the motor 210 to the feed roller 251 until the trailing edge in the feed direction F1 of the medium P on which recording is performed by the line head 51 passes through the nip position between the feed roller 251 and the separation roller 252. For this reason, in the printer 1 of the present embodiment, it is possible to suppress a sudden change in the transport distance per unit time in a state in which recording is being performed by the line head 51, and it is possible to suppress a decrease in recording quality.

Second Embodiment

Figure 13:
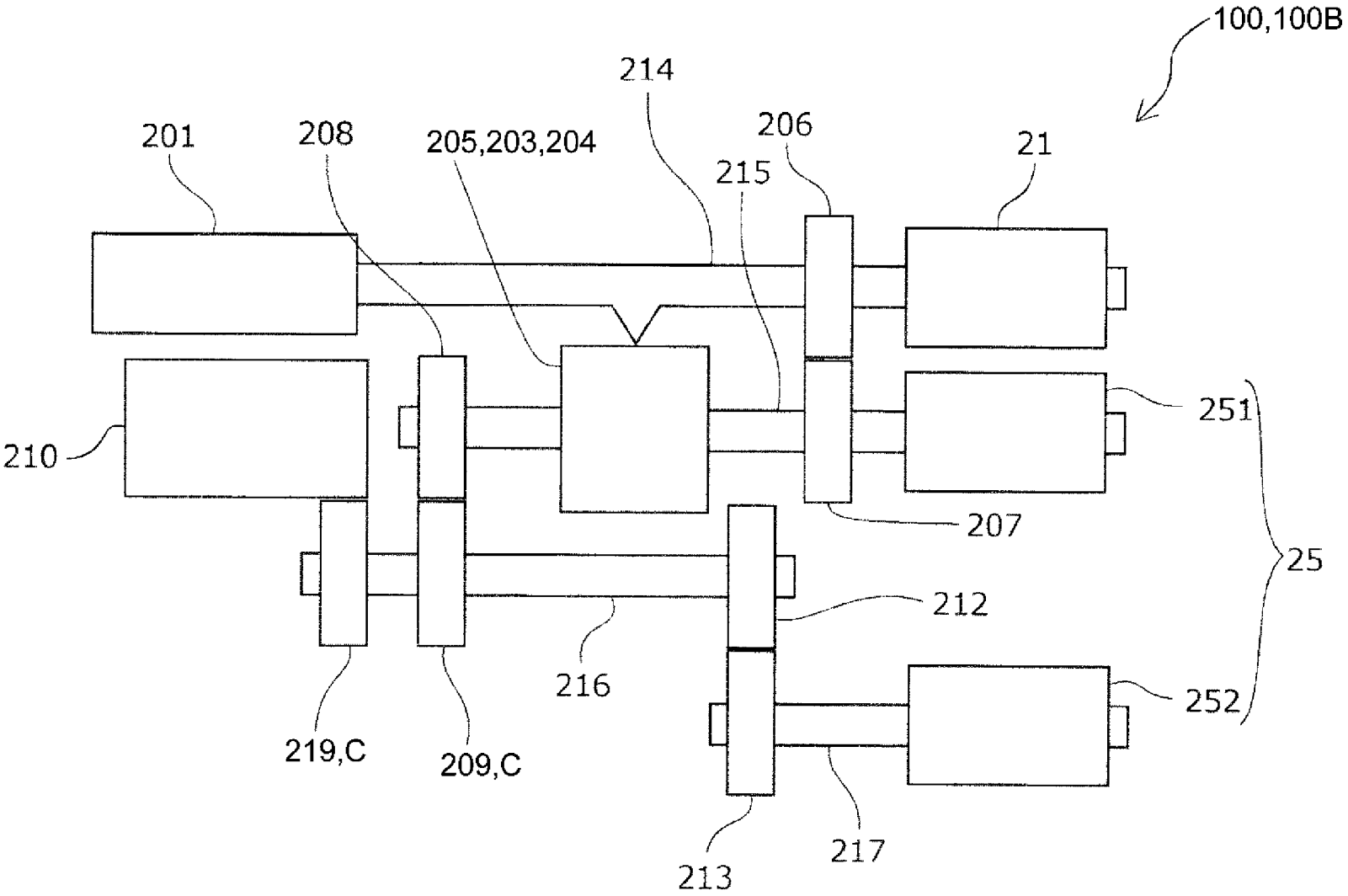
FIG. 13 is a block diagram of the drive mechanism section of the printer according to a second embodiment of the present disclosure.

Hereinafter, the drive mechanism section 100 of the printer 1 of a second embodiment will be described with reference to FIG. 13. FIG. 13 is a diagram corresponding to FIG. 6 in the printer 1 according to the first embodiment. The printer 1 of the present embodiment is the same as the printer 1 of the first embodiment except for the configuration described below. Specifically, only the configuration of the drive mechanism section 100 is different from that of the printer 1 of the first embodiment, and more specifically, only the arrangement of the gears having the clutch C with respect to the drive mechanism section 100A of the first embodiment is different from that of the printer 1 of the first embodiment. For this reason, the printer 1 according to the present embodiment has the same features as the printer 1 according to the first embodiment except for the following description. Therefore, in FIG. 13, components common to those in the first embodiment are denoted by the same reference symbols, and detailed description thereof is omitted.

As shown in FIG. 6, in the drive mechanism section 100A according to the first embodiment, the clutch C is attached only to the gear 209 that meshes with the gear 208 attached to the rotation shaft 215 of the feed roller 251. On the other hand, as shown in FIG. 13, in a drive mechanism section 100B of the present embodiment, the clutch C is also attached to a gear 219 that receives the driving force from the motor 210. Therefore, even when the motor 210 is driven, the drive mechanism section 100B according to the present embodiment can prevent the rotation shaft 217 of the separation roller 252 from receiving the driving force from the motor 210. With such a configuration, for example, it is possible not to drive the separation roller 252 in addition to the pickup roller 21 and the feed roller 251 while driving some of the plurality of rollers provided in the printer 1 by driving the motor 210.

Third Embodiment

Figure 14:
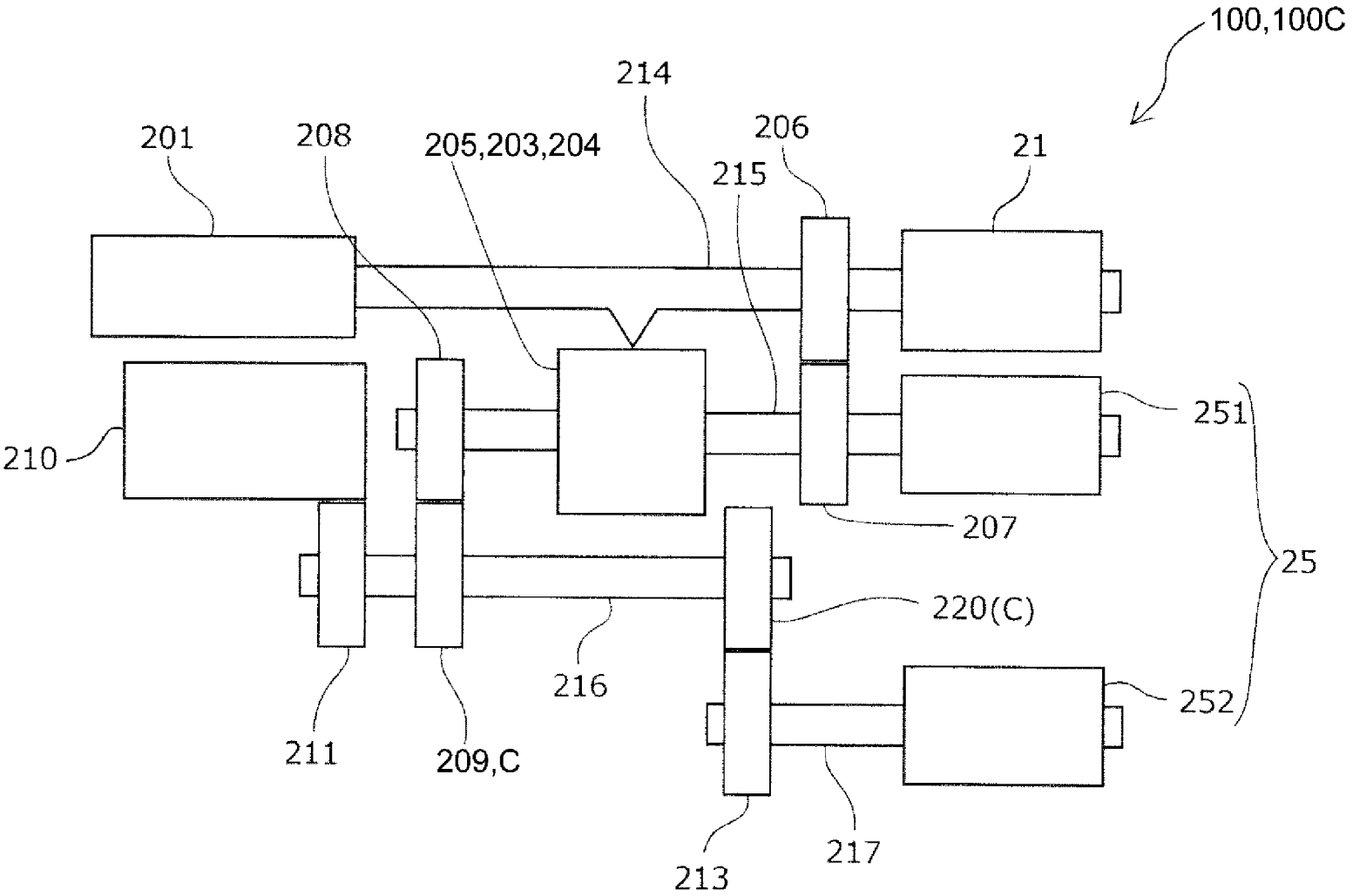
FIG. 14 is a block diagram of the drive mechanism section of the printer according to a third embodiment of the present disclosure.

Hereinafter, the drive mechanism section 100 of the printer 1 of a third embodiment will be described with reference to FIG. 14. FIG. 14 is a diagram corresponding to FIG. 6 in the printer 1 according to the first embodiment. The printer 1 of the present embodiment is the same as the printer 1 of the first embodiment except for the configuration described below. Specifically, only the configuration of the drive mechanism section 100 is different from that of the printer 1 of the first embodiment, and more specifically, only the arrangement of the gears having the clutch C with respect to the drive mechanism section 100A of the first embodiment is different from that of the printer 1 of the first embodiment. For this reason, the printer 1 according to the present embodiment has the same features as the printer 1 according to the first embodiment except for the following description. Therefore, in FIG. 14, components common to those in the first embodiment are denoted by the same reference symbols, and detailed description thereof is omitted.

As shown in FIG. 6, in the drive mechanism section 100A according to the first embodiment, the clutch C is attached only to the gear 209 that meshes with the gear 208 attached to the rotation shaft 215 of the feed roller 251. On the other hand, as shown in FIG. 13, in a drive mechanism section 100C of the present embodiment, the clutch C is also attached to a gear 220 fitted with the gear 213 attached to the rotation shaft 217 of the separation roller 252. Therefore, even when the motor 210 is driven, the drive mechanism section 100B according to the present embodiment can prevent the rotation shaft 217 of the separation roller 252 from receiving the driving force from the motor 210. Even with such a configuration, similarly to the drive mechanism section 100B of the second embodiment, for example, it is possible not to drive the separation roller 252 in addition to the pickup roller 21 and the feed roller 251 while driving some of the plurality of rollers provided in the printer 1 by driving the motor 210.

The present disclosure is not limited to the embodiments described above, and various modifications can be made within the scope of the disclosure described in the claims, and it is needless to say that these are also included in the scope of the present disclosure.

What is claimed is:

1. A medium transport device comprising:

a placement section on which a medium is placed;

a feed roller configured to feed the medium from the placement section in a feed direction, the feed roller being provided on a rotation shaft;

a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium;

a drive mechanism section configured to drive the feed roller and the separation roller, wherein the drive mechanism section includes a drive section that generates a driving force and a one way clutch section that is provided in a transmission path, which transmits the driving force to the feed roller, the one way clutch comprising a sliding locking section operatively coupled to a transport roller, wherein movement of the sliding locking section in a direction along the rotation shaft is synchronized with movement of the transport roller between a separated state where the transport roller is separated from the medium and a contacted state where the transport roller is in contact with the medium, the one way clutch section is configured to switch between an allowed state in which the one way clutch section allows the feed roller to rotate in a rotation direction in which the feed roller moves the medium in the reverse feed direction and the transport roller is moved upwards to the separated state, and a restricted state in which the one way clutch section allows the feed roller to rotate only in a rotation direction in which the feed roller moves the medium in the feed direction and the transport roller is moved downwards to the contacted state, and the drive mechanism section that causes the one way clutch section to enter the allowed state and that causes the separation roller to rotate in the rotation direction in which the medium moves in the reverse feed direction.

2. The medium transport device according to claim 1, wherein the transport roller is provided upstream of the feed roller in the feed direction and that is configured to transport the medium from the placement section toward the feed roller, wherein the drive mechanism section is configured to transmit the driving force to the transport roller, and the drive mechanism section switches the one way clutch section between the restricted state and the allowed state by a switching operation of the switching section between the contacted state and the separated state.

3. The medium transport device according to claim 2, wherein the drive mechanism section brings the one way clutch section into the restricted state when the switching section brings the transport roller into the contacted state, and brings the one way clutch section into the allowed state when the switching section brings the transport roller into the separated state.

4. The medium transport device according to claim 1, wherein the one way clutch section has a star ratchet.

5. The medium transport device according to claim 1, further comprising:

a skew correction section that is provided downstream of the feeding roller in the feed direction and that is configured to contact the medium and to correct skew of the medium, wherein when the medium fed by the feed roller comes into contact with the skew correction section, the drive mechanism section brings the one way clutch section into the restricted state and interrupts transmission of the driving force to the feed roller.

6. The medium transport device according to claim 5, further comprising:

a transport roller that is provided upstream of the feed roller in the feed direction and that is configured to transport the medium from the placement section toward the feed roller, wherein the drive mechanism section includes a switching section that switches the transport roller between a contacted state in which the transport roller is in contact with the medium and a separated state in which the transport roller is separated from the medium, the drive mechanism section is configured to transmit the driving force to the transport roller, the skew correction section includes a transport roller pair that transports the medium, and when the medium whose skew was corrected by the skew correction section is transported by the transport roller pair, the switching section switches the transport roller from the contacted state to the separated state.

7. The medium transport device according to claim 5, further comprising:

a recording section that is provided downstream of the skew correction section in the feed direction and that is configured to perform recording on the medium, wherein the drive mechanism section continues to transmit the driving force to the feed roller until a trailing edge in the feed direction of the medium on which recording is being performed by the recording section passes through a nip position between the feed roller and the separation roller.

8. A medium transport method for a medium transport device, the medium transport device including:

a placement section on which a medium is placed;

a feed roller configured to feed the medium from the placement section in a feed direction;

a separation roller that is configured to rotate in a rotation direction which moves the medium in a reverse feed direction, which is a direction toward the placement section and which is opposite to the feed direction, and that is configured to nip the medium together with the feeding roller to separate a sheet of medium from a stack of sheets of the medium;

a drive mechanism section for driving the feed roller and the separation roller;

a drive section that generates a driving force; and a one way clutch section that is provided in a transmission path, that transmits the driving force to the feed roller, the one way clutch comprising a sliding locking section operatively coupled to a transport roller, wherein movement of the sliding locking section in a direction along the rotation shaft is synchronized with movement of the transport roller between a separated state where the transport roller is separated from the medium and a contacted state where the transport roller is in contact with the medium, and that configured to switch between an allowed state in which the one way clutch section allows the feed roller to rotate in a rotation direction in which the feed roller moves the medium in the reverse feed direction and the transport roller is moved upwards to the separated state, and a restricted state in which the one way clutch section allows the feed roller to rotate only in a rotation direction in which the feed roller moves the medium in the feed direction and the transport roller is moved downwards to the contacted state, the medium transport method comprising:

a feeding step of feeding the medium in the feed direction by nipping the medium between the feed roller and the separation roller and a subsequent medium returning step of causing the one way clutch section to enter the allowed state and of rotating the separation roller in the rotation direction in which the medium moves in the reverse feed direction to return, in the reverse feeding direction, a subsequent medium, which is a medium subsequent to a preceding medium transported in the feeding step.

* * * * *